US010493640B2

(12) United States Patent
Shendelman

(10) Patent No.: US 10,493,640 B2
(45) Date of Patent: Dec. 3, 2019

(54) PORTABLE FOOD SERVICE ASSEMBLY

(71) Applicant: Leonid Shendelman, Brooklyn, NY (US)

(72) Inventor: Leonid Shendelman, Brooklyn, NY (US)

( * ) Notice: Subject to any disclaimer, the term of this patent is extended or adjusted under 35 U.S.C. 154(b) by 275 days.

(21) Appl. No.: 15/450,414

(22) Filed: Mar. 6, 2017

(65) Prior Publication Data

US 2017/0172328 A1 Jun. 22, 2017

Related U.S. Application Data

(63) Continuation-in-part of application No. 14/171,820, filed on Feb. 4, 2014, now abandoned.

(60) Provisional application No. 61/760,291, filed on Feb. 4, 2013, provisional application No. 61/790,285, filed on Mar. 15, 2013.

(51) Int. Cl.
*A47G 19/02* (2006.01)
*B26B 3/02* (2006.01)

(52) U.S. Cl.
CPC ..... *B26B 3/02* (2013.01); *A47G 19/065* (2013.01)

(58) Field of Classification Search
CPC ..... A47G 19/065; A47G 19/02; A47G 19/06; A47G 19/30; A47G 19/022; A47G 21/001; A47G 21/145; A47G 21/14; A47G 21/08; A47G 2400/06; A47G 23/06; B65D 3/02; A47J 47/14; A47J 47/145
USPC ..... 220/575, 574
See application file for complete search history.

(56) References Cited

U.S. PATENT DOCUMENTS 4,505,506 A * 3/1985 Picozza ..... A45F 3/46 294/161
5,497,883 A * 3/1996 Monetti ..... A47J 39/006 206/545

* cited by examiner

*Primary Examiner* — Anthony D Stashick
*Assistant Examiner* — L E Kmet
(74) *Attorney, Agent, or Firm* — Kirschstein, Israel, Schiffmiller & Pieroni, P.C.

(57) ABSTRACT

A portable food service assembly includes a support and a plate non-threadedly attached to, and detached from, the support. The assembly includes eating utensils and accessories, and can readily be carried by an individual from one place to another with one hand, and can be readily supported and held without tipping on a support surface, including in a compartment of a cupholder. All the components of the assembly are disposable, biodegradable, and, if desired, reusable.

32 Claims, 20 Drawing Sheets

FIG. 5
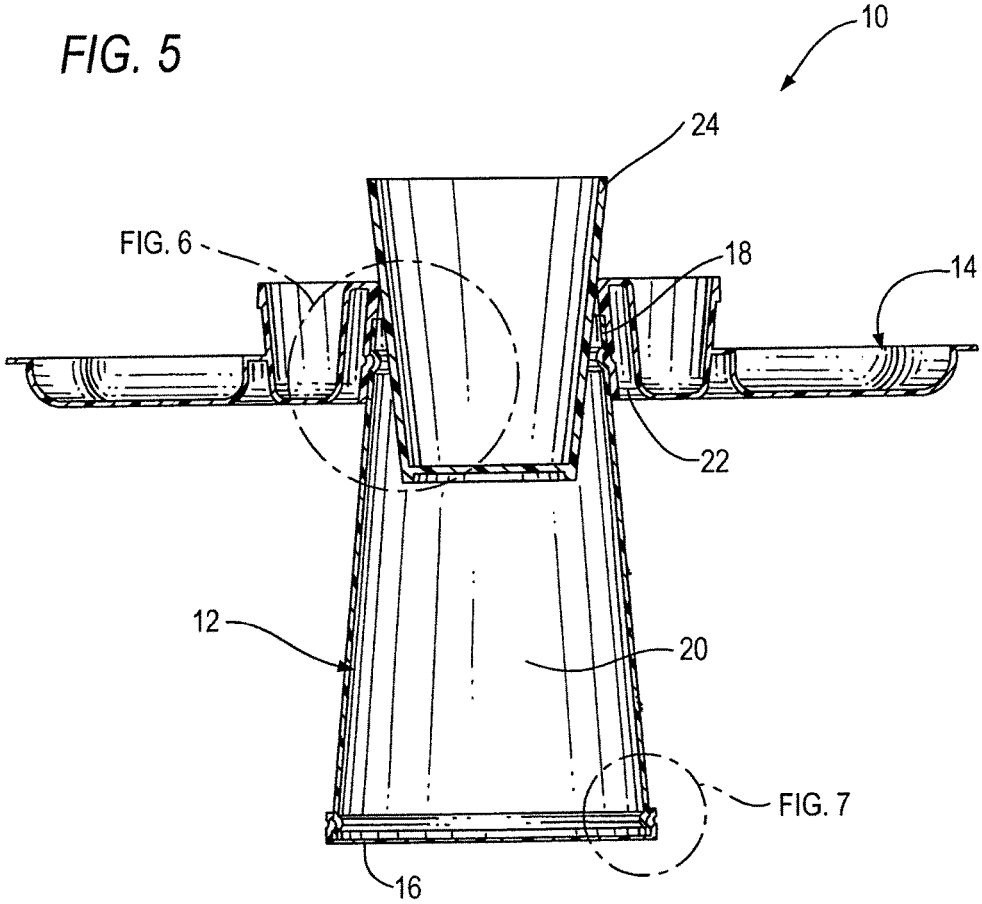
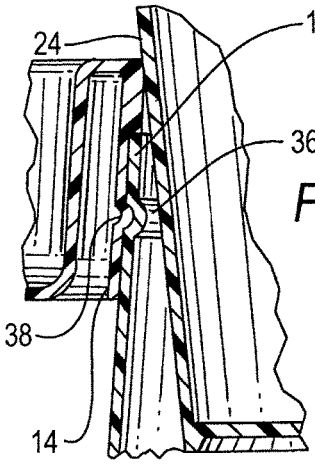
FIG. 6
FIG. 7
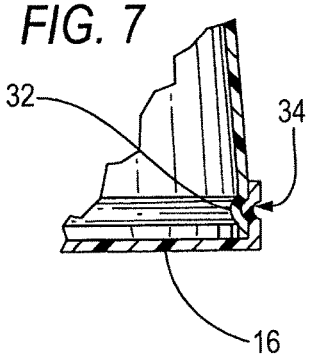

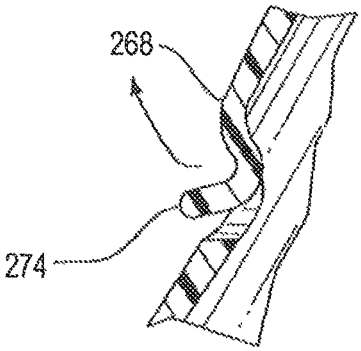
FIG. 24
FIG. 25
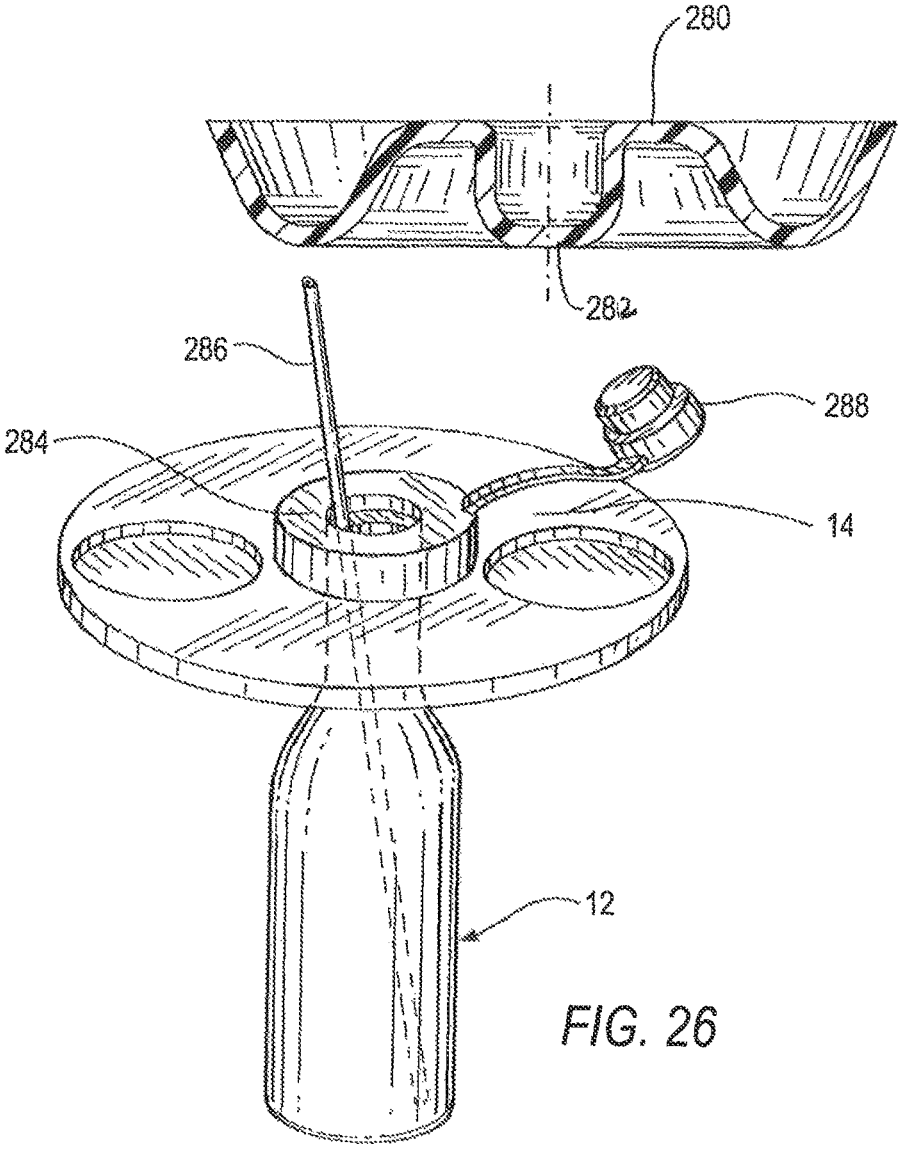
FIG. 26

PORTABLE FOOD SERVICE ASSEMBLY

CROSS REFERENCE TO RELATED APPLICATIONS

This application is a continuation-in-part of U.S. patent application Ser. No. 14/171,820, filed Feb. 4, 2014, which, in turn, claims the priority benefit of U.S. Provisional Patent Application Ser. No. 61/760,291, filed Feb. 4, 2013, and of U.S. Provisional Patent Application Ser. No. 61/790,285, filed Mar. 15, 2013, the entire contents of said applications being hereby incorporated herein by reference thereto.

FIELD OF THE DISCLOSURE

The present disclosure generally relates to a portable food service assembly, especially a portable organizer of food, drinks, and eating utensils and accessories, for use, for example, by guests at social gatherings at which food and drink are served buffet style, as well as for use by customers at take-out or drive-through restaurants, snackbars, concession stands, and like premises, and, in addition, for use at hospitals, nursing homes, rehabilitation centers, schools, cafeterias, universities, and like facilities.

BACKGROUND

Guests fill their plates with food at social functions, and typically either hold their plates in cantilever fashion by gripping peripheral edges of the plates, or balance their plates on their laps. If drinks are also served, the guests typically either hold their beverage containers in their other hands, or balance the containers on their plates. Due to the difficulty in performing such balancing, and due to the difficulty of supporting the plates and the containers without food or beverage spillage, guests often seek out a table or like supporting surface, or even the floor, to support their plates and beverage containers. Yet, this action tends to anchor guests to a specific location and prevents the guests from roaming and socializing. In a similar vein, customers of take-out or drive-through restaurants, snackbars, concession stands, and like premises, who are served food on plates and drinks in beverage containers, often find it difficult to support them all without spillage, especially when leaving and carrying the food and drink away from the premises for subsequent consumption at another location, for example, at their homes, in their vehicles, or in their seats at movies, concerts, sporting events, etc.

Another problem resides in the management of accessories such as eating utensils and napkins. Once an individual has been served with food on a plate and a beverage in a container, there is usually no room, or available hand, for holding eating utensils or napkins. Since a food-laden plate is typically held in one hand and a beverage-filled container is typically held in the other hand, the utensils are often stuck directly into the food or placed on top of the food, while the napkin is typically disregarded, or perhaps stuffed in one's pocket, if available. As the individual proceeds from place to place, the jarring from walking sometimes causes the utensils to fall off the plate, in which case the individual is more or less helpless to retrieve them.

In U.S. Pat. No. 6,971,613, the art proposed a plate stand to alleviate such problems and to assist users in more comfortably handling food, drinks, eating utensils, and accessories. Although generally satisfactory for its intended purpose, the known plate stand required a separate threaded element to be turned in order to threadedly interconnect a plate and a handheld support. Experience has shown that sometimes the threaded element was prone to being misplaced and becoming lost. Also, a certain mount of dexterity was needed to complete the threaded interconnection. Not all users had this dexterity. Also, the known plate stand required a separate adapter to mount the known plate stand in a compartment of a cupholder that was, for example, provided in a vehicle, or adjacent a seat. This adapter was likewise prone to being misplaced. Accordingly, it would be desirable to alleviate such problems.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the instant disclosure, and explain various principles and advantages of those embodiments.

FIG. 5 is a sectional view taken on line 5-5 of FIG. 4.

FIG. 6 is an enlarged view of a circled area in FIG. 5.

FIG. 7 is an enlarged view of another circled area in FIG. 5.

FIG. 24 is an enlarged, broken-away view of a detail of a support for the assembly of FIG. 1.

FIG. 25 is a broken-away view of a detail of the assembly of FIG. 1.

FIG. 26 is a perspective view on a reduced scale of another portable food service assembly in accordance with this disclosure.

Figure 1:
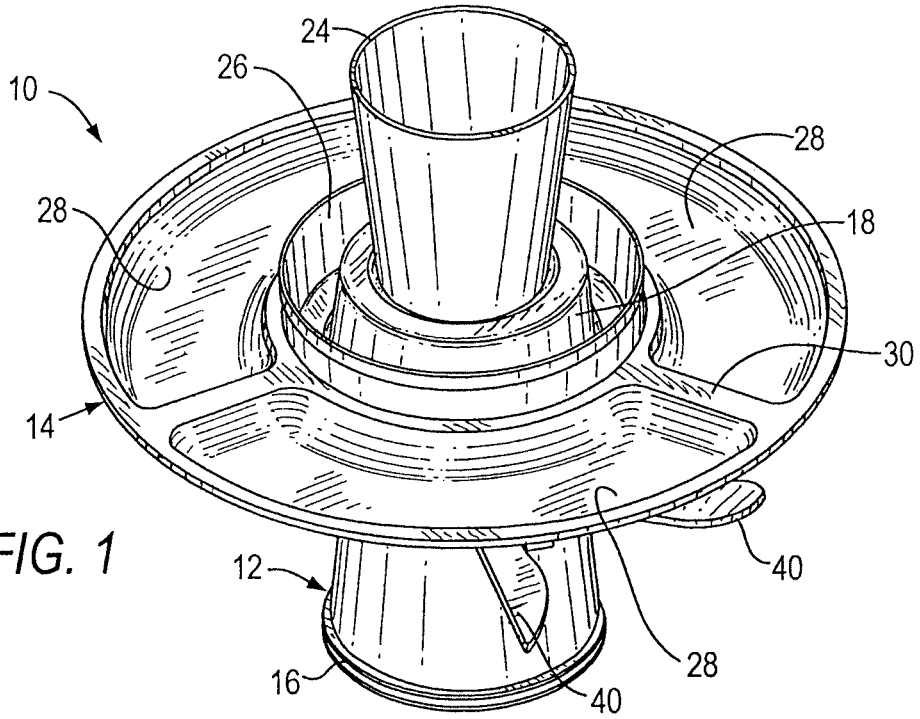
FIG. 1 is a perspective view of a portable food service assembly in accordance with one embodiment of this disclosure.

Skilled artisans will appreciate that elements in the figures are illustrated for simplicity and clarity and have not necessarily been drawn to scale. For example, the dimensions and locations of some of the elements in the figures may be exaggerated relative to other elements to help to improve understanding of embodiments of the present disclosure.

The components of the portable food service assemblies have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

One feature of this disclosure relates to a portable food service assembly that includes an upright support configured to be gripped by a user's hand, and a plate having at least one compartment for containing food. The plate is detachably mounted on the support with a non-threaded fit, e.g., a friction fit, an interference fit, a snap action fit, or a clearance fit. The plate is supported by the support and is carried by the user's hand. Preferably, the support is elongated along a longitudinal axis, and the plate and the support are non-threadedly connected to each other by axial movement relative to each other along the longitudinal axis. In one advantageous embodiment, an annular projection is provided on the plate or the support, and an annular recess is provided on the other of the plate or the support, in which case, the recess receives the projection with mechanical interference when the plate and the support are axially moved towards each other until they are press fit together. Thus, in contrast with the known art, there is no separate threaded element to be misplaced or manipulated. The non-threaded interconnection of the plate and the support is easily achieved by axially moving the plate and the support towards each other along the longitudinal axis, and their non-threaded disconnection is also easily achieved by axially moving the plate and the support apart from each other. Preferably, the connection between the plate and the support affirmatively resists excessive tilting of the plate, and prevents the plate from disengaging from the support.

Turning now to the drawings, reference numeral 10 in FIGS. 1-7 generally identifies a first embodiment of a portable organizer or food service assembly having a support 12 and a plate 14 detachably mounted thereon with a non-threaded fit, as described below. The support 12 includes a base 16, a top 18, and an upright tubular column 20 extending along a longitudinal axis vertically between the base 16 and the top 18. The column 18 need not be frustoconical in shape as illustrated, but could have other shapes, e.g., cylindrical, as well as the other shapes described below. The top 18 extends through and past an aperture 22 centrally located in the plate 14. The top 18 is open and, thus, is free to receive a beverage container or cup 24, which is preferably held with a friction fit inside the open top 18. The cup 24 may be removed and replaced at will. The cup 24 need not be frustoconical in shape as illustrated, but could have other shapes, e.g., cylindrical. The plate 14 also may have a central annular bowl 26 (shown only in FIGS. 1, 2 and 4) to collect any liquid spillage from the cup 24. The cup 24 may contain cold beverages, such as soda, alcohol, a milk shake, etc., or hot beverages, such as coffee, tea, hot chocolate, soup, etc. For balance, it is preferred that the cup 24 be centrally located relative to the plate 14 as illustrated, but it is also contemplated that the cup 24 may be offset from the longitudinal axis, or positioned at the center of gravity of the assembly.

The plate 14 and the support 12 may each be made of a disposable, biodegradable material such as paper or cardboard, or of a more permanent material such as metal, plastic, or porcelain for re-use. The plate 14 has at least one compartment 28, and preferably a plurality of compartments 28, for holding food. As shown, each compartment is sector-shaped, and is bounded by equiangularly spaced-apart radial ribs 30. It will be understood that the compartments may have other shapes, as described below. Preferably, the plate 14 is microwavable for preheating food.

The tubular column 20 could be solid or hollow, and has a diameter sized to be readily gripped in the palm of a user's hand so that the assembly may easily be carried by one hand from place to place. The base 16 has a planar bottom surface for stable mounting on a generally planar support surface, such as the floor or a table. If the support surface is made of a metal material, then, in one advantageous embodiment, the bottom surface of the base 16 may be constituted of a magnetic material for magnetic attraction to, and holding by, the metallic support surface. The base 16 could therefore be of one-piece with the column, or could be a separate detachable part that can be readily attached to the column. For example, the base 16 can be threadedly or magnetically attached to the column, or, as shown in FIG. 7, can be attached by a snap-type action, wherein an annular recess 32 provided on the column 20 receives, with a snap fit, an annular collar 34 provided on the base 16. The positions of the recess 32 and the collar 34 could be reversed.

Figure 34:
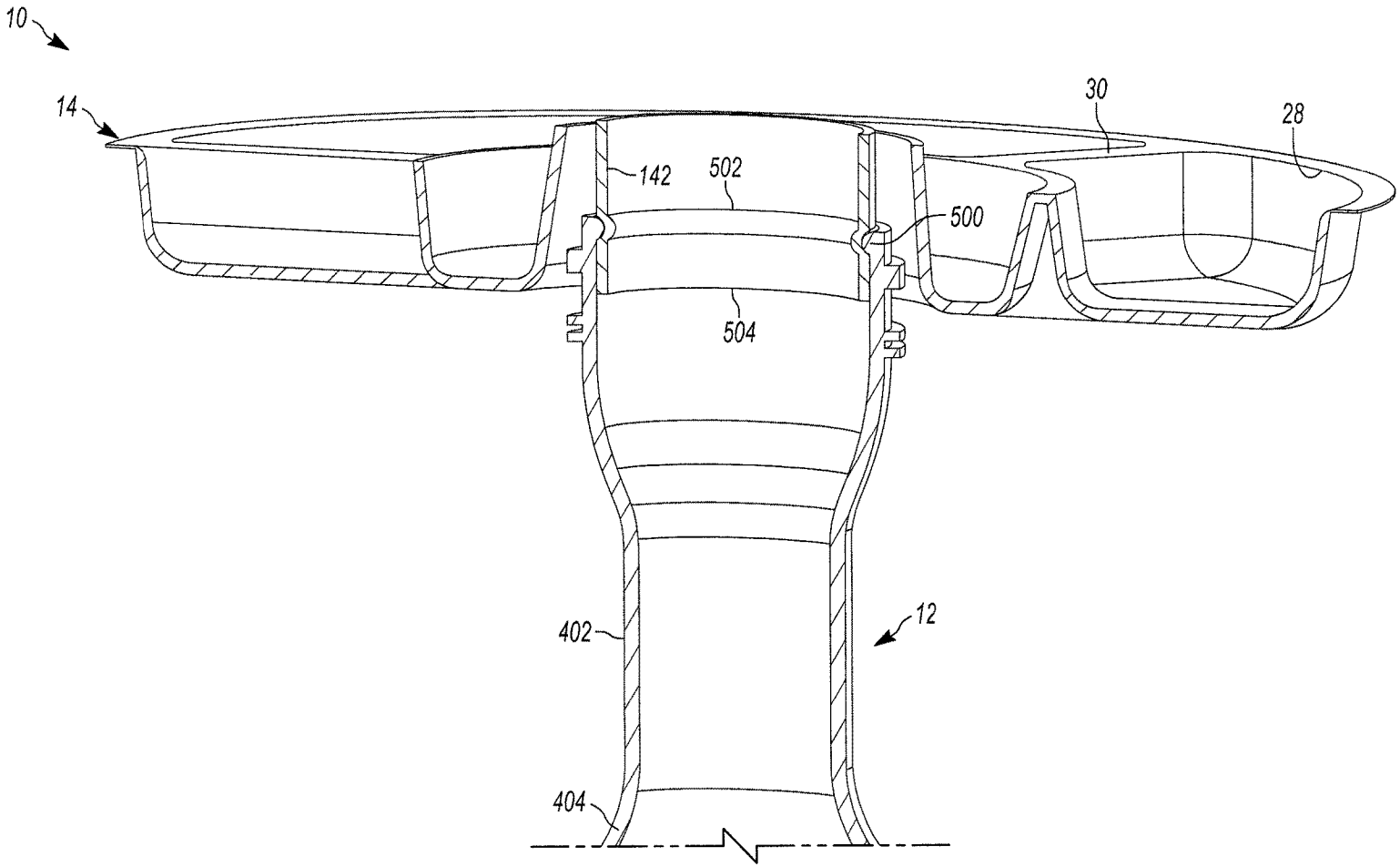
FIG. 34 is a broken-away, sectional view taken on line 34-34 of the embodiment of FIG. 32, with the cup removed.

Similarly, as stated above, the plate 14 can be mounted and press-fitted on the support 12 with a snap-type action. As shown in FIG. 6, an annular recess 36 provided on the top 18 receives, with a snap fit, an annular projection or collar 38 provided on the plate 14. The positions of the recess 36 and the collar 38 could be reversed, as described below in connection with FIGS. 34-36. Thus, the plate 14 is readily, quickly and easily attached to the support 12 without requiring a separate threaded element to be provided or manipulated. The plate 14 is also readily, quickly and easily removable from the support 12 for cleaning or for replacement with a fresh plate by axially moving the plate 14 away from the support 12.

Figure 2:
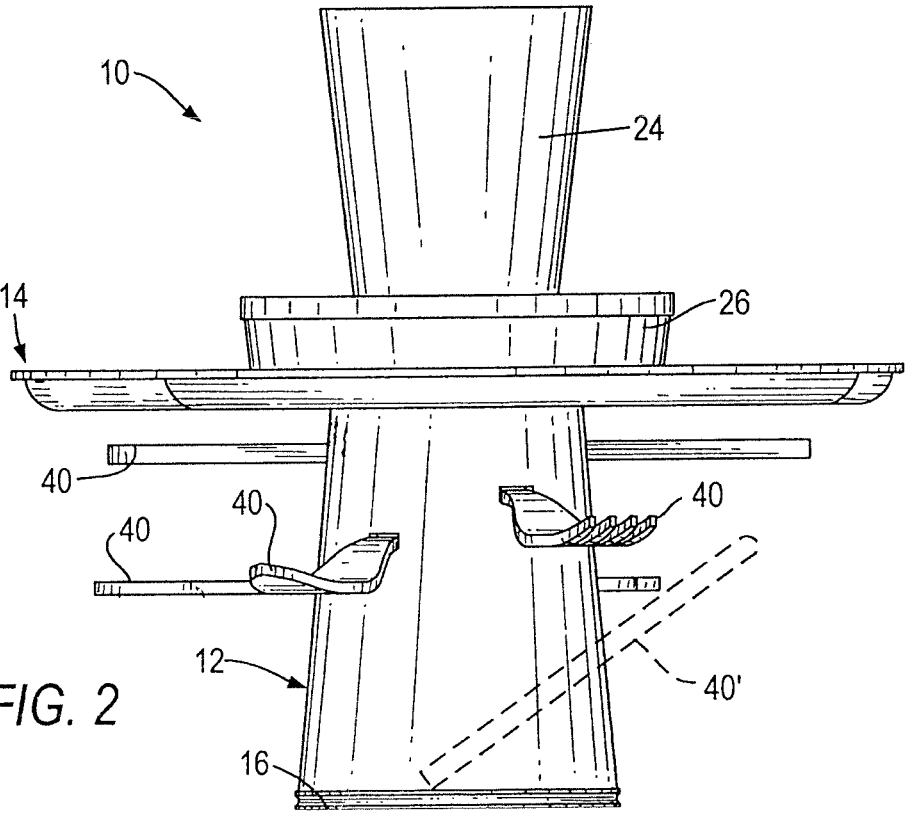
FIG. 2 is a side elevational view of the embodiment of FIG. 1.
Figure 3:
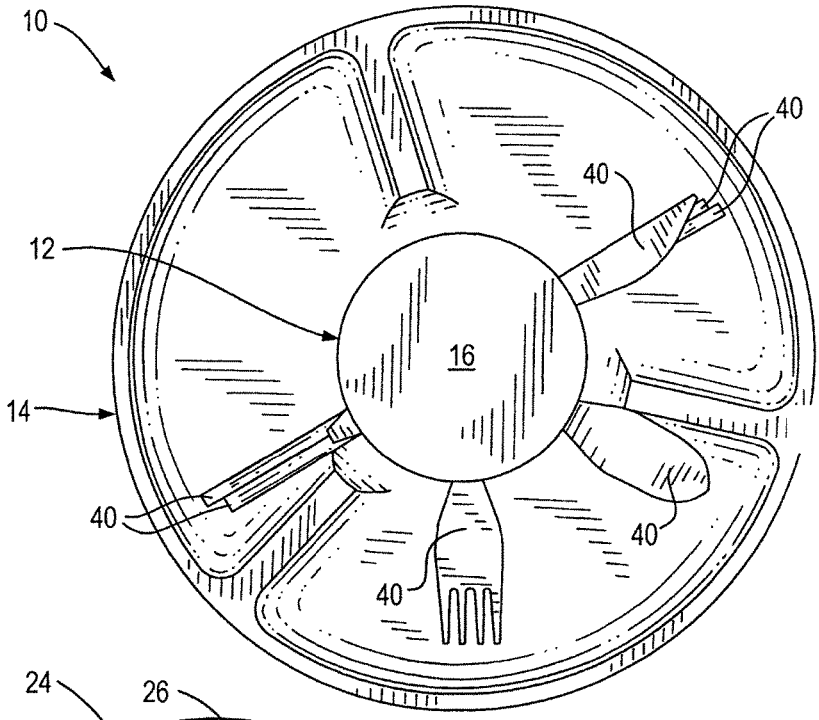
FIG. 3 is a bottom plan view of the embodiment of FIG. 1.
Figure 4:
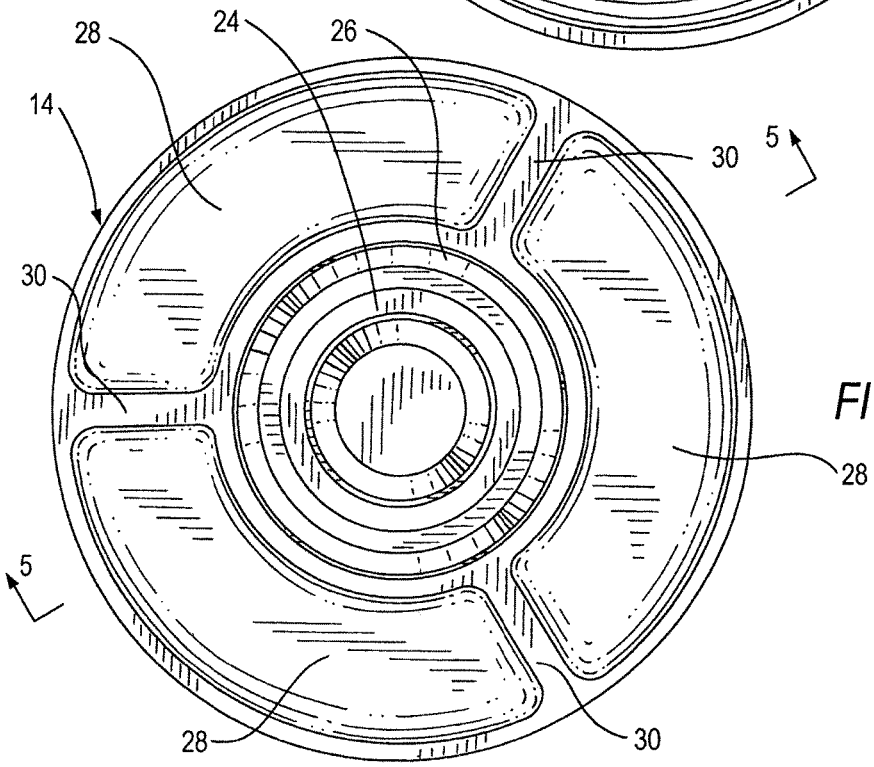
FIG. 4 is a top plan view of the embodiment of FIG. 1.
Figure 8:
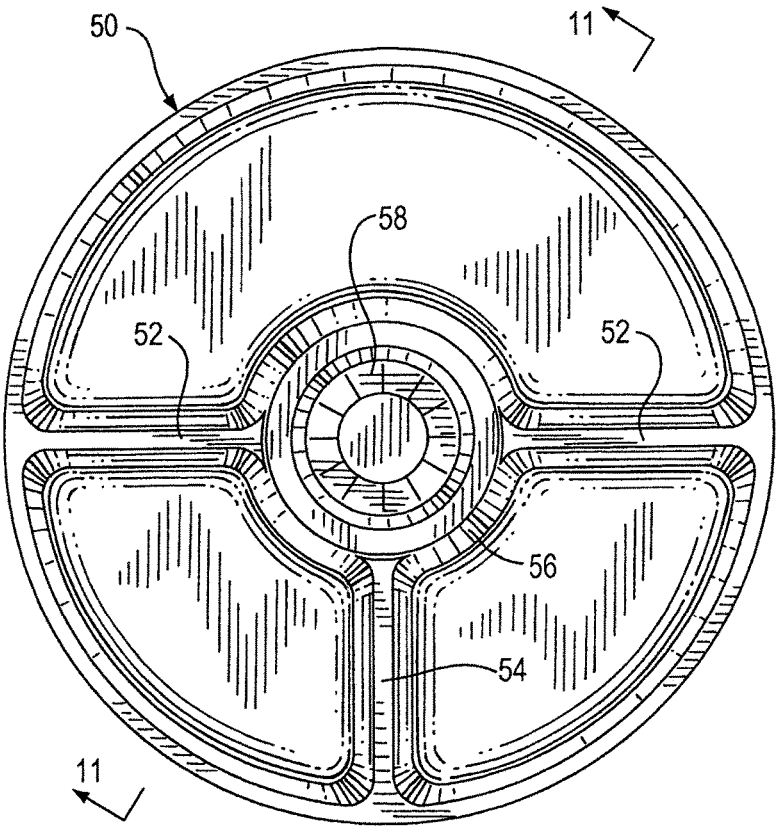
FIG. 8 is a top plan view of a portable food service assembly in accordance with another embodiment of this disclosure.

As depicted in FIGS. 1-3, a plurality of eating utensils 40, such as a knife, fork, spoon, or pair of chopsticks are mounted on the support 12, preferably by being inserted through slots in the column 20 underneath the plate 14. The slots are aligned to receive each utensil 40 in a generally horizontal plane, or, as shown by the dashed lines 40' in FIG. 2, a single angled slot may be employed to receive and hold a utensil 40 in an inclined plane. Chopsticks are typically longer than other utensils and have heretofore been difficult to handle. Now, the easy and convenient storage and securement of the chopsticks allows customers of Oriental foods, such as sushi, to utilize take-out and drive-through restaurants, snackbars, concession stands, and like premises.

Figure 9:
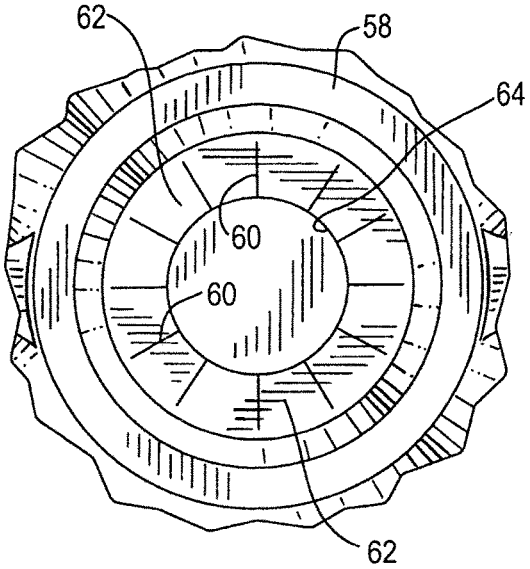
FIG. 9 is a top plan view of a cup holder for use in the embodiment of FIG. 8.
Figure 10:
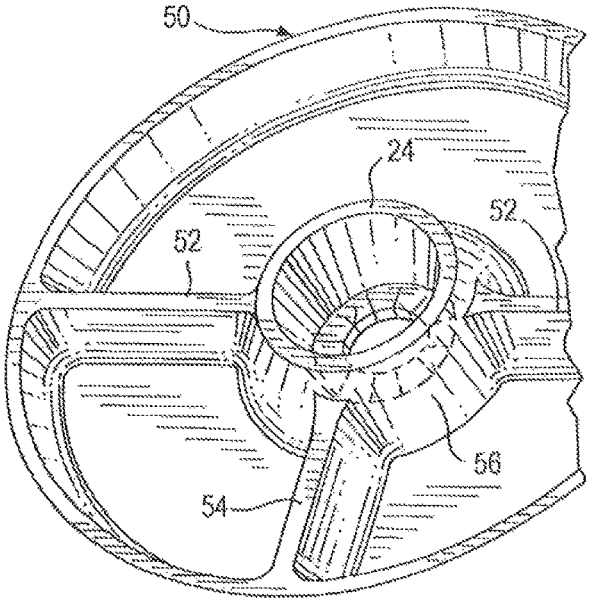
FIG. 10 is a broken-away, perspective view of the embodiment of FIG. 8 when used with a cup.
Figure 11:
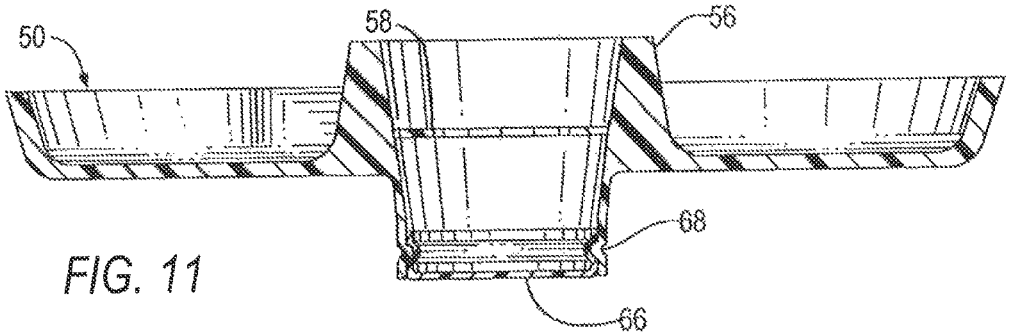
FIG. 11 is a sectional view taken on line 11-11 of FIG. 8.
Figure 12:
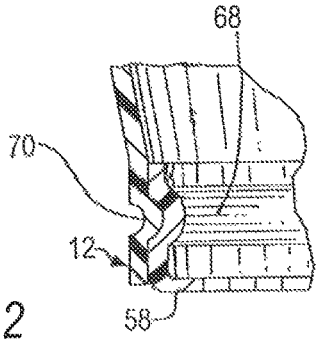
FIG. 12. is an enlarged view of a snap-type, press fit, connection between the plate and a modified cupholder of FIG. 8.

Reference numeral 50 in FIGS. 8-12 generally identifies a modified plate, analogous to plate 14, for detachable mounting on the support 12, or a modified support. Rather than the equiangularly spaced-apart radial ribs 30 shown in FIGS. 1 and 4, the plate 50 has two horizontally aligned ribs 52 and a vertical rib 54. Rather than an open top 18 of a column 12 in which the cup 24 is freely inserted as shown in FIG. 1, the plate 50 has an integral raised annular neck 56 centrally located thereon. A cup holder portion 58, shown in isolation in FIG. 9, is integral with the neck 56. The cup holder portion 58 has a plurality of equiangularly spaced-apart slits 60. Each adjacent pair of slits 58 bounds a resiliently yieldable element or finger 62 or tab that yields as the cup 24 is inserted into a central aperture 64. Different cups 24 may have different sizes, and the resilient fingers 62 will yield to the requisite extent to accommodate the size of the cup 24 being inserted into the cup holder portion 58. As illustrated in FIG. 12, in a variation, the cup holder portion 58 is a separate element formed with an annular recess 68 for receiving an annular projection or ridge 70, with a snap fit, provided on the support 12. The positions of the recess 68 and ridge 70 could be reversed.

The plate 50, as best seen in FIG. 11, has a bottom extension 66 centrally located at the underside of the plate 50. The extension 66 has an annular recess 68. Although the extension 66 is illustrated in FIG. 11 as extending vertically below the underside of the plate 50, it will be understood that the extension 66 could be raised and located substantially entirely within the neck 56.

Figure 13:
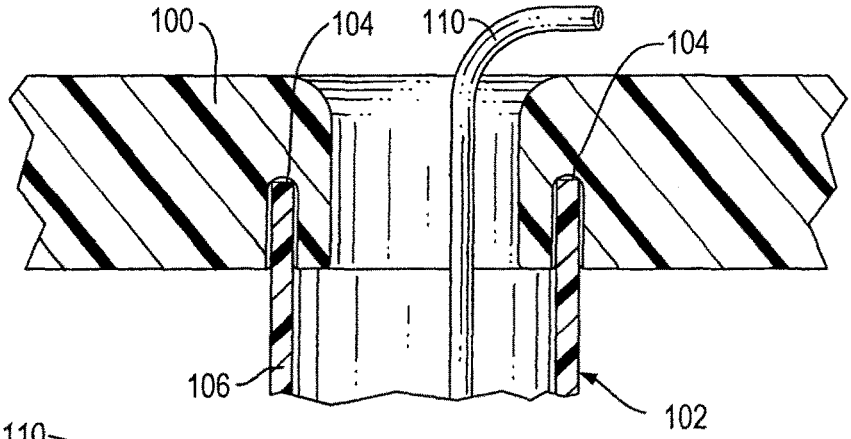
FIG. 13 is a broken-away, enlarged sectional view of a modification of a connection between a plate and a support in accordance with this disclosure.
Figure 14:
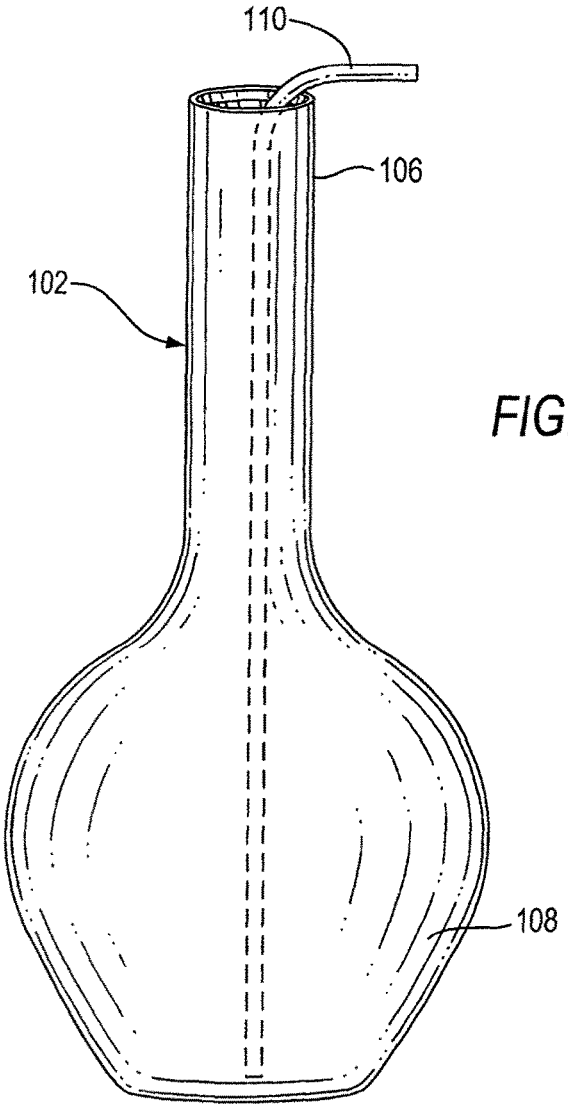
FIG. 14 is a side elevational view of a modification of the support for use with this disclosure.

FIG. 13 depicts a central portion of another plate 100, analogous to plates 14 and 50 and detachably mounted with a loose fit on a modified support 102, as shown in FIG. 14. The plate 100 has an annular, preferably circular, recess 104 at its underside, and the support 102 has a cylindrical upper portion 106 that is axially received within the recess 104. The plate 100 is simply axially slid onto the upper portion 106 along the longitudinal direction. In some cases, the plate 100 may even be free to rotate relative to the upper portion 106 about a vertical axis extending along the longitudinal direction. The non-threaded, slip-on, connection between the plate 100 and the support 102 is sufficient to support the plate 100 in a generally horizontal plane. In a variation, the connection between the plate 100 and the support 102 may be a tight friction fit.

The support 102 also has an enlarged lower portion 108 that is configured to be received in a cupholder that may be provided in a vehicle, such as a car, boat, or plane, typically in a console or dashboard area adjacent a seat, or in an armchair or seat, such as those located in theaters, arenas, stadiums, outdoor seating areas, etc. Thus, the support 102 enables the plate 100 to be conveniently supported and stably held anyplace where a cupholder exists. If the cupholder includes a metal material, then, in another advantageous embodiment, the bottom surface of the support 102 may be constituted of a magnetic material for magnetic attraction to, and holding by, the metallic material of the cupholder. The support 102 is preferably hollow and shaped as a vase to accommodate any of the aforementioned beverages, e.g., alcohol. A straw 110 is insertable through the plate 100 and into the support 102 to enable the beverage to be drunk. Thus, the support 102 also serves as a beverage holder in this embodiment.

Figure 15:
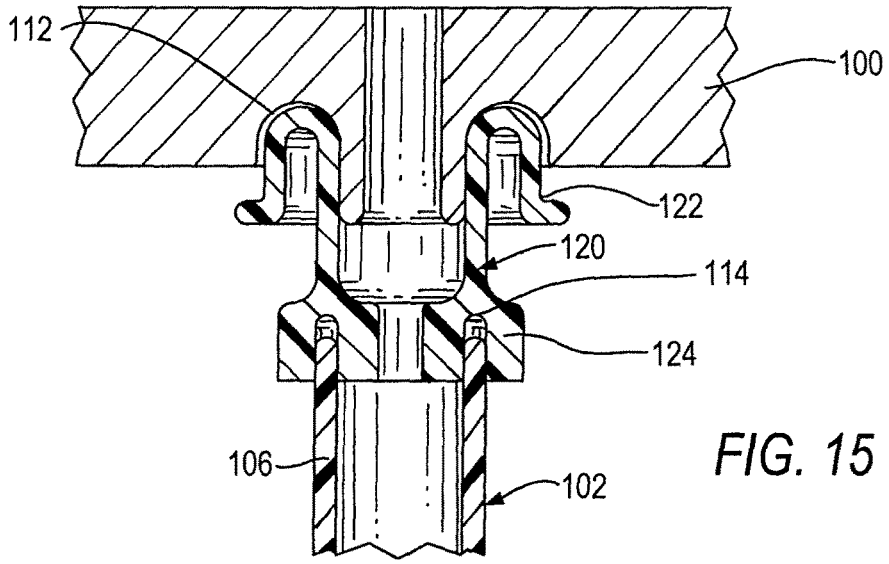
FIG. 15 is a view analogous to FIG. 13, but of a modification.

FIG. 15 depicts a modification of the embodiment of FIG. 13. An adapter 120 is mounted between the plate 100 and the support 102. The adapter 120 has an upper resilient portion 122 that is resiliently received in an annular recess 112 at the underside of the plate 100, and a lower portion 124 that has an annular groove 114 at its bottom surface. The resilient portion 122 is initially squeezed radially inwardly during insertion into the recess 112, and then, is released, whereupon the resilient portion 122 radially expands to grip the wall bounding the recess 112. Thus, the cylindrical upper portion 106 of the support 102 is received in a tight friction fit within the groove 114. Different adapters can be used to accommodate different supports and different plates.

Figure 16:
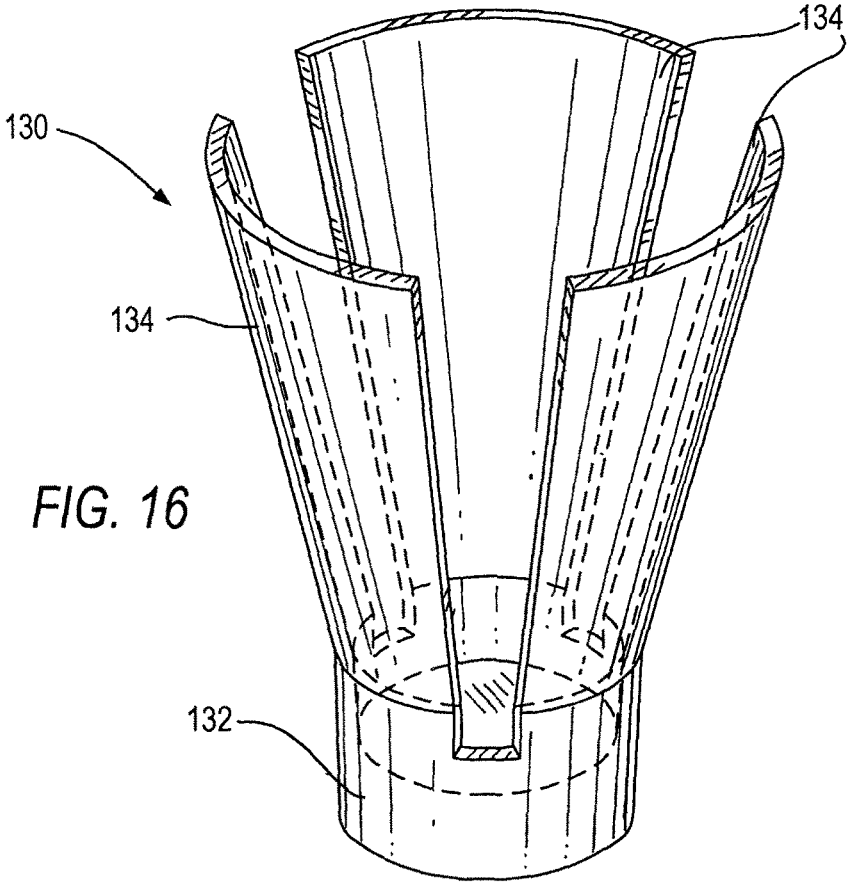
FIG. 16 is an enlarged perspective view of a universal container holder in accordance with this disclosure.

FIG. 16 depicts a universal container holder 130 for receiving variously sized containers or cups, such as the cup 24. The container holder 130 of FIG. 16 has a lower mounting portion 132 that may be inserted into the neck 56 of the plate 50, and a plurality of equiangularly spaced-apart upright resilient elements or arms 134 extending upwardly away from the lower mounting portion 132. The resilient arms 134 are spaced apart by slots and circumferentially embrace the cup 24 inserted into the container holder 130. Different cups 24 may have different sizes, and the resilient arms 134 will yield to the requisite extent to accommodate the size of the cup 24 being inserted into the container holder 130. The container holder 130 may also he used by itself, without being mounted on the plate 50. Hot or cold beverages, ice cream, yogurt, or like foodstuffs may he contained in the cup 24 that is held by the holder 130.

Figure 17:
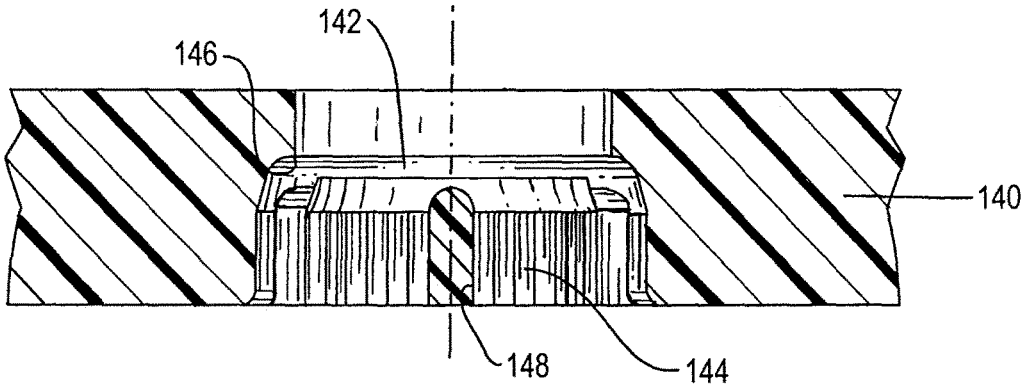
FIG. 17 is a view analogous to FIG. 13, but of another modification.
Figure 18:
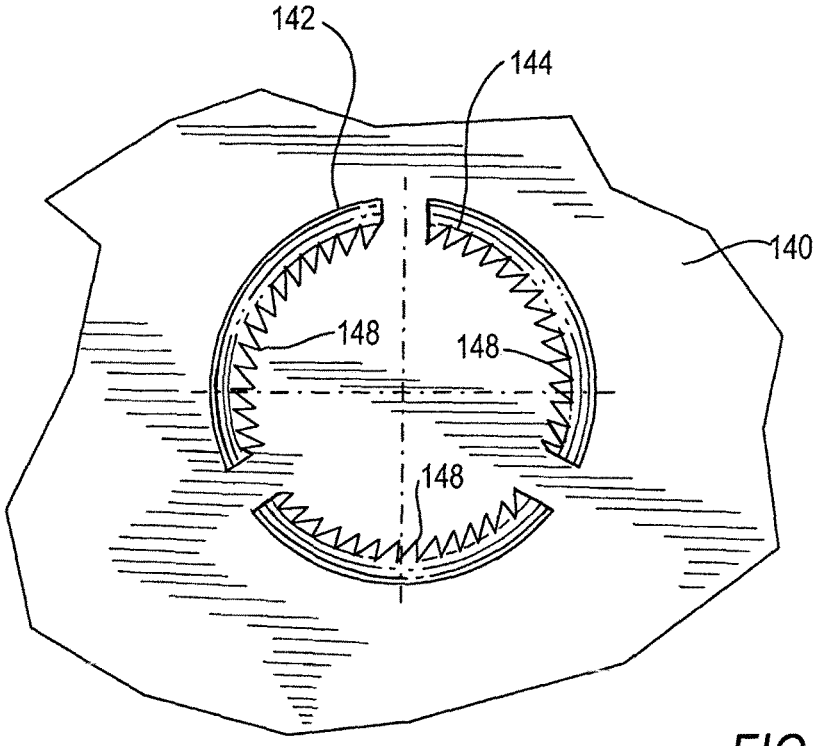
FIG. 18 is a broken-away, bottom plan view of the modification of FIG. 17.

FIGS. 17-18 depict a central portion of another plate 140, analogous to plates 14 and 50 and detachably mounted with a press fit on the support 102. The plate 140 has a central annular extension portion 142 whose exterior annular surface is provided with a multitude of serrations or teeth 144. An annular recess 146 surrounds the extension portion 142. The cylindrical upper portion 106 of the support 102 is received in the recess 146. The teeth 144 bite into and firmly grip an interior surface of the cylindrical upper portion 106. A plurality of radial slots 148 are equiangularly arranged to provide flexibility to the extension portion 142.

Figure 19:
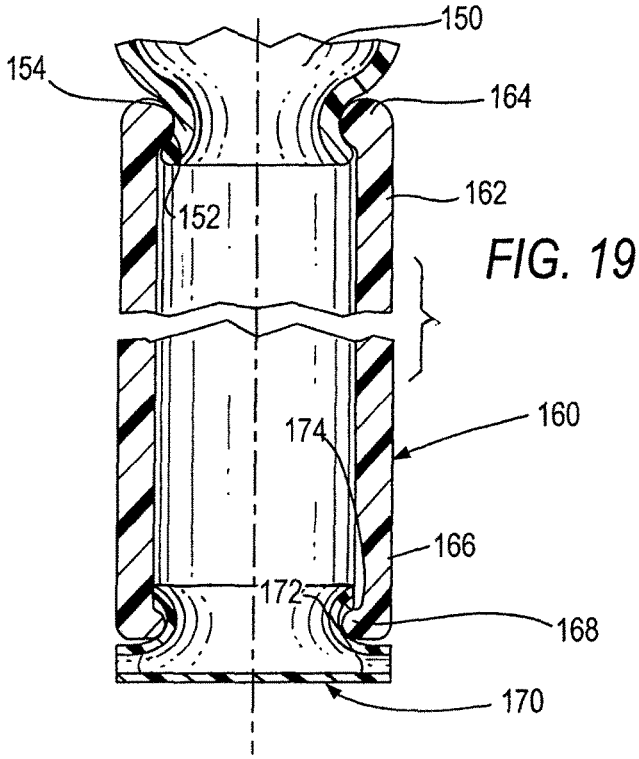
FIG. 19 is a broken-away, sectional view of another modification.

FIG. 19 depicts another embodiment in which a plate 150 has a lower extension 152 having an annular recess or constricted waist 154 that has a reduced diameter and that extends radially inwardly, and a cylindrical support 160 having an upper part 162 formed with a projection or top flange 164 that also extends radially inwardly, and a lower part 166 formed with a bottom flange 168. A base 170 has an upper extension 172 having an annular groove 174. The top flange 164 is radially received with a snap-type fit in the waist 154 to detachably mount the plate 150 on the support 160. The bottom flange 168 is received with a snap-type fit in the groove 174 to detachably mount the base 170 on the support 160.

Figure 20:
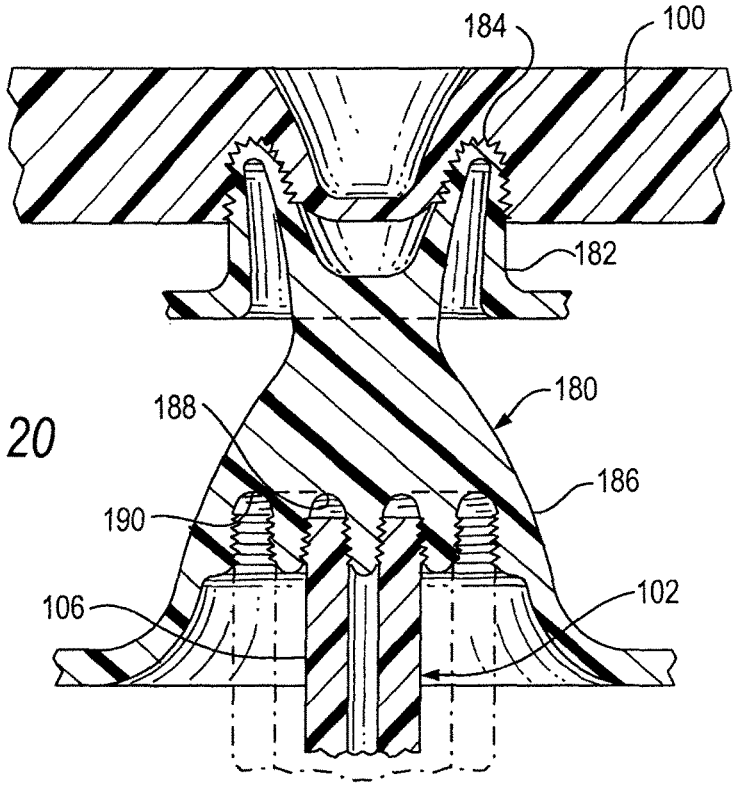
FIG. 20 is a view analogous to FIG. 15, but of a modification.

FIG. 20 depicts a modification of the embodiment of FIG. 15. An adapter 180 is mounted between the plate 100 and the support 102. The adapter 180 has an upper resilient portion 182 that is resiliently received in an annular recess 184 at the underside of the plate 100, and a lower resilient portion 186 that has an inner annular groove 188 and an outer annular groove 190 at its bottom surface. Although two grooves 188, 190 have been illustrated, any number of grooves can be formed at the bottom surface of the adapter 180. The interior surfaces of the recess 184 and each groove 188, 190 may be roughened, for example, formed with serrations. The resilient portion 182 is initially squeezed radially inwardly during insertion into the recess 184, and then, is released, whereupon the resilient portion 182 radially expands to more friction-tightly grip the roughened surface bounding the recess 184. The cylindrical upper portion 106 of the support 102 is received in a tight friction fit either within the roughened surface bounding the groove 188 as shown in solid lines, or within the roughened surface bounding the groove 190 as shown in broken lines. The roughened surfaces bounding each groove 188, 190 increase the mutual frictional engagement. Thus, different sizes of the upper portion 106 of the support 102 are accommodated. The resilient portion 186 may also be initially squeezed radially inwardly, and then released. Different adapters can be used to accommodate different supports and different plates.

Figure 21:
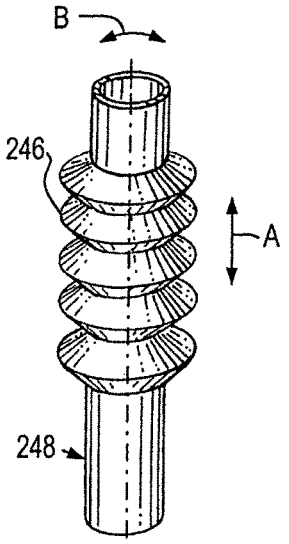
FIG. 21 is a side view of an additional embodiment of a support for the assembly of FIG. 1.

FIG. 21 depicts an adjustable, flexible support 248 for connection to the plate 14. The adjustable support 248 has a column 246 configured as a bellows that can be extended or contracted in height in the directions of the double-headed arrow "A", and/or which can also be tilted from side-to-side in the directions of the double-headed arrow "B" to accommodate any change in orientation or position of the plate 14.

Figure 22:
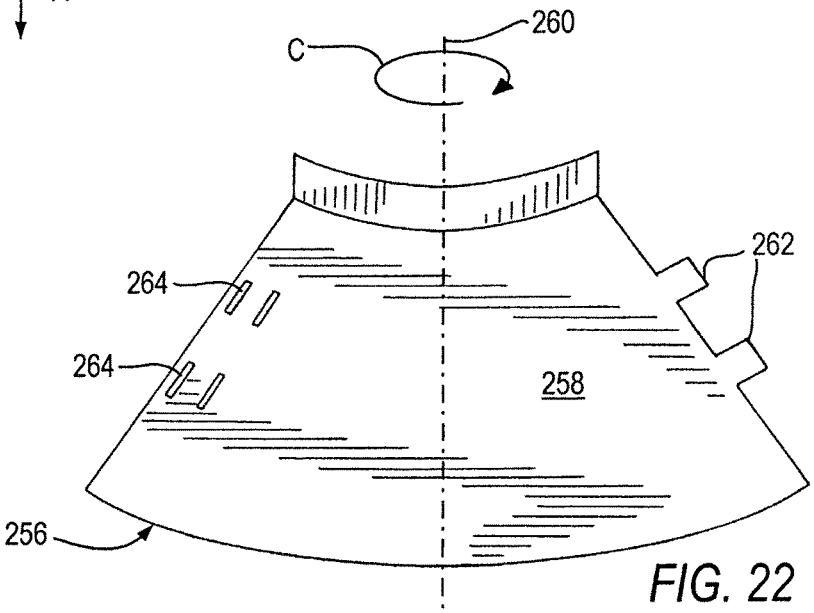
FIG. 22 is a top plan view of yet another embodiment of a support for the assembly of FIG. 1.

FIG. 22 depicts another support 256 for connection to the plate 14. The support 256 is formed from an initially flat, sector-shaped, sheet 258, e.g., of paper, plastic, metal, etc., that is rolled about the axis 260 in the direction of the arrow "C" to form a frustoconical shape for the support 256. A pair of locking tabs 262 at one edge of the sheet 258 are inserted into a pair of slots 264 adjacent an opposite edge of the sheet to hold and lock the sheet in the frustoconical shape. The support 256 can also be rolled into other shapes.

Figure 23:
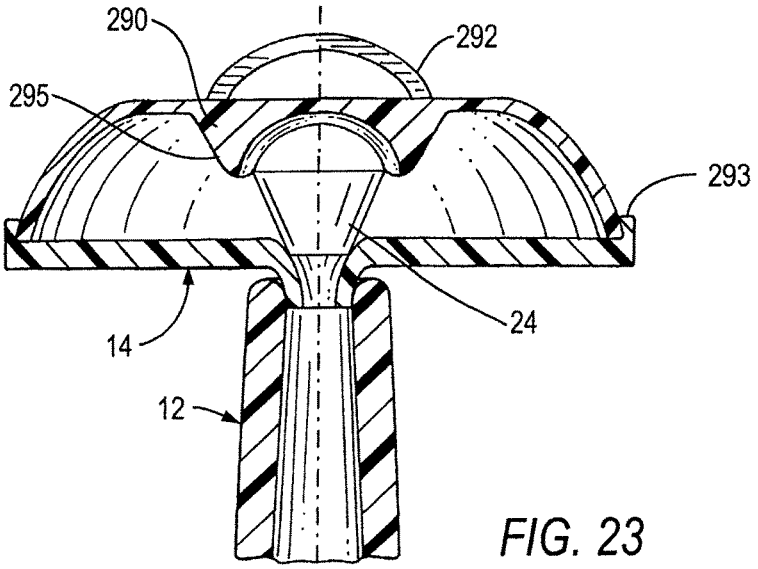
FIG. 23 is a cross-sectional view on a reduced scale of still another portable food service assembly in accordance with this disclosure.

FIG. 23 depicts a variant construction of a food service assembly in which the plate 14 is again mounted on the support 12, but in which a generally dome-shaped cover 290 having a centrally positioned handle 292 is positioned over the plate 14 and the cup 24 to protect the food and drink therein. The cover 290 may he secured and locked in position on the plate 14 by being press-fitted into an annular seat 293. Alternatively, the cover 290 may be secured by other interlocking means, for example, by being rotationally threaded onto the plate, or by being snap-fit onto the plate, or by being axially moved and then circumferentially turned in a bayonet mount. This permits the entire assembly to be balanced and securely carried from place to place. In addition, an internal holder or projection 295 has a cavity into which the cup 24 is received and held in position. The cavity is sized to accommodate a range of cups 24 of different sizes and shapes. The internal holder 295 may be integral with the cover 290, or may be a separate piece that is placed on the cup 24. The internal holder 295 may be constituted of a flexible, resilient material, such as a foam cushion, or of a collapsible material, such as a bellows or an accordion, that accommodates a range of cups 24 of different sizes and shapes. Motion by the user during carrying of the assembly by the handle 292 will not dislodge the cup 24 from its secure mounting by the holder 295. Although FIG. 23 illustrates a single cup 24, this invention is not intended to be so limited, because more than one cup could also be mounted on the plate, in which case, the plate serves as a tray or carrier for securely and safely carrying multiple cups 24 with multiple holders 295 without spilling of hot or cold beverages from place to place. In the latter case, the support 12 is optional and can be omitted.

In a modification, the support 12 can also comprise a stack of multiple frustoconically-shaped supports 268 vertically stacked one atop another. The overall height of the support stack is adjusted by selecting the number of the supports 268. FIG. 24 depicts a side wall of a representative support 268 formed with a resilient flap or tongue 74 that frictionally grips the side wall of another support 268, thereby holding the stacked supports 268 apart by a predetermined distance. The opening formed by the flap 274 in the uppermost support 268 in the stack can be used to support any item, such as the utensils 40, napkins, hooks for electronic devices, etc.

FIG. 25 depicts another modification. Rather than configuring the bowl 26 as in FIG. 2 with an open central extension, the bowl 280 of FIG. 11 has an extension 282 whose lower end is closed.

FIG. 26 depicts a modified food service assembly in which the plate 14 is again mounted on the support 12, but the support 12 is configured with a bottle shape and can hold a liquid, such as a soft drink or a juice. A cap 284 is mounted at a central region of the plate 14. A straw 286 is inserted through the cap 284 into the bottle to enable a user to drink the liquid therein. A plug 288 is used to plug the cap 284 after the straw 286 is removed.

Figure 27:
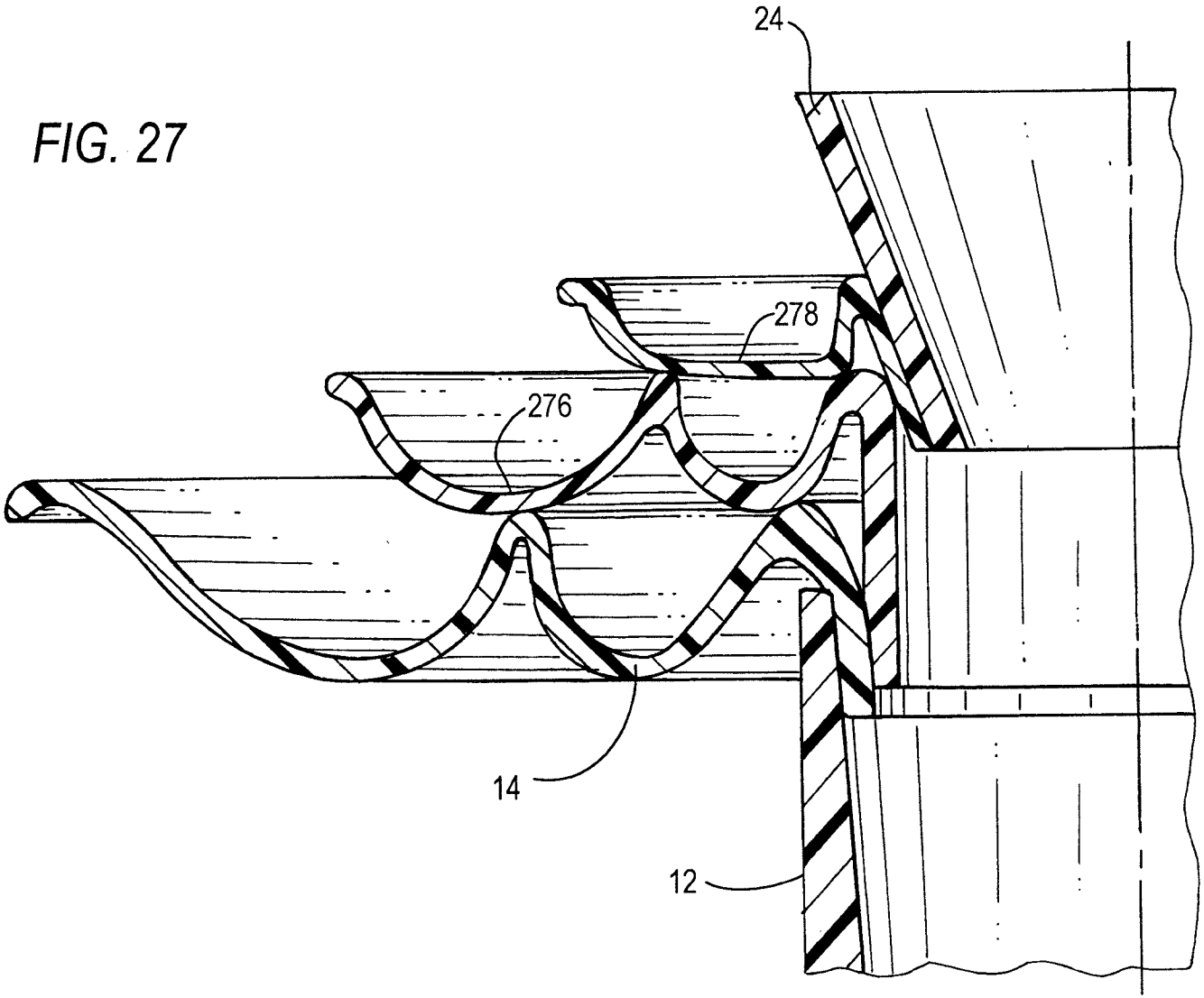
FIG. 27 is a broken-away, sectional view of a peripheral region of another portable food service assembly in accordance with this disclosure.

FIG. 27 depicts another modification. Rather than mounting just one plate 14 on the support 12 as shown in FIG. 1, FIG. 27 depicts that two additional plates 276, 278 can be mounted on the plate 14. The additional plates 276, 278 can advantageously be used to hold and separate foods, such as sushi, gourmet foods, appetizers, sauces, spices, jams, ice creams, nuts, etc. The plates 14, 276, 278 are circular and preferably have successively decreasing diameters. The plates 14, 276, 278 can be equiangularly arranged so that, when viewed from above, they are arranged in a rosette pattern.

Figure 28:
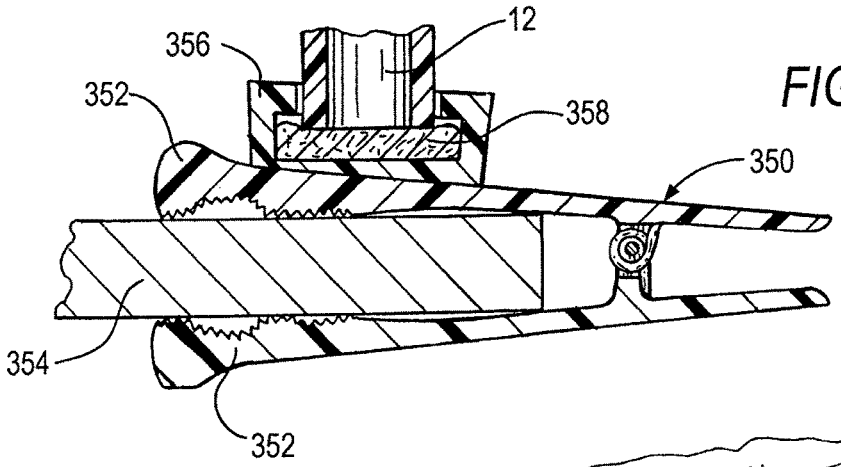
FIG. 28 is a broken-away, enlarged, sectional view of a variant construction of a food service assembly.

As described so far, the lower end of the support 12 of the food service assembly is adapted to be supported on top of a generally horizontal support surface, such as a table top or countertop, with the aid of the base 16. Other mounting configurations are also contemplated. For example, FIG. 28 depicts a spring-biased clip or clamp 350 having opposing jaws 352 that grip upper and lower surfaces of a generally horizontal support surface 354. The jaws 352 could also be concave to grip opposite sides of a different support surface, such as a round post or pole. The lower end of the support 12 is connected to the clamp 350 via an adapter 356 in which a resilient cushion 358 is received. The cushion 358 compresses under the weight of the food service assembly and self-adjusts as needed in order to compensate for any tilting of the support 12 created by any variation in the size of the support surface 354 and any variation in the opening of the clamp 350. The adapter 356 need not be mechanically fixed to the clamp 350 as shown, but could be magnetically attached thereto, and could also be mounted for turning movement about a vertical axis thereon.

Figure 29:
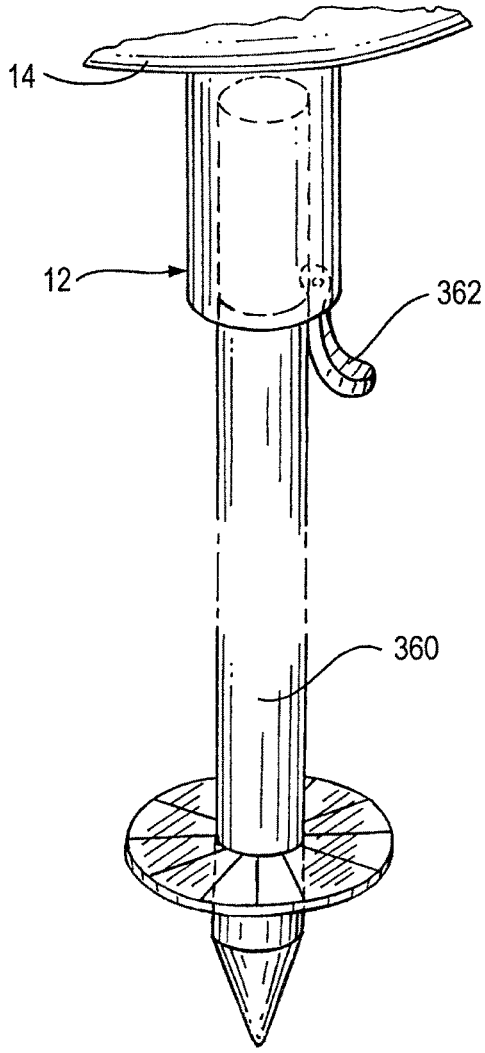
FIG. 29 is a broken-away, side view of another variant construction of a food service assembly.

As another example, the lower end of the support 12 can be mounted on a round post or pole staked into the ground or sand as on a beach, or in the snow. FIG. 29 depicts a ski pole 360 on which a food service assembly comprised of a plate 14 and a support 12 are detachably mounted with the aid of a tubular clamp 362.

Figure 30:
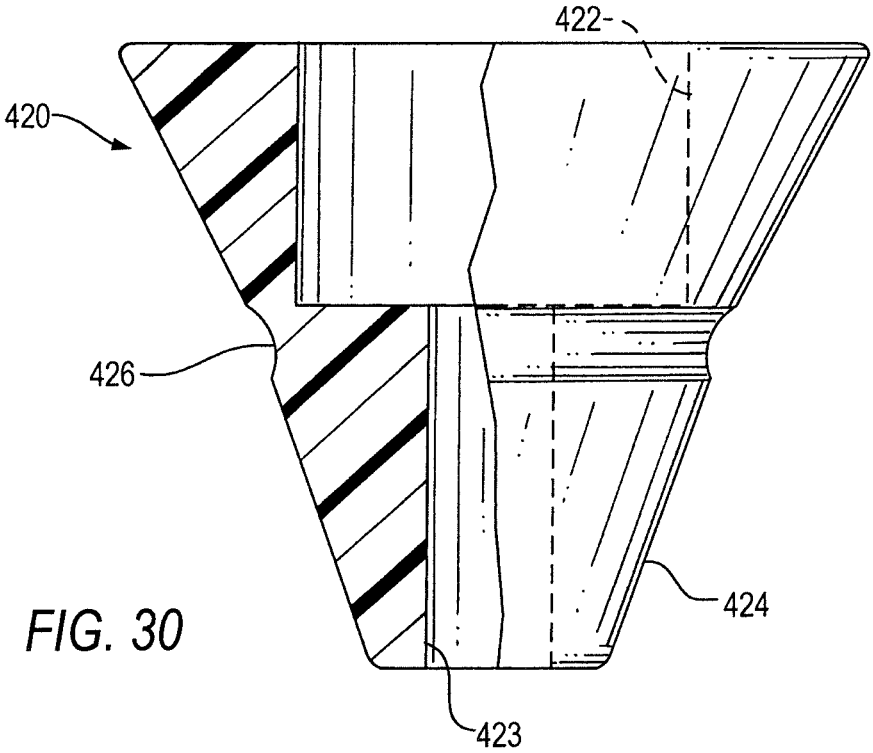
FIG. 30 is a sectional view of one embodiment of an adapter for use in a cupholder.
Figure 31:
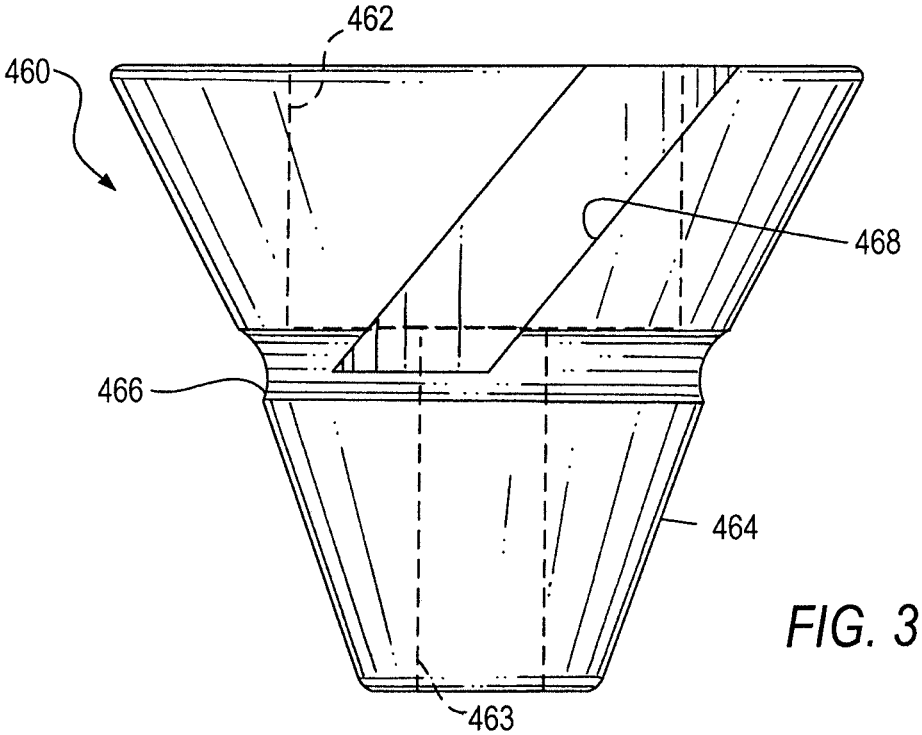
FIG. 31 is an elevational side view of another embodiment of an adapter for use in cupholder.

FIGS. 30 and 31 are side views of two different embodiments of adapters or connectors 420, 460 that are used to hold supports, such as support 160 of FIG. 19, upright in correspondingly sized compartments of cupholders that may be provided in a vehicle, such as a car, boat, or plane, typically in a console or dashboard area adjacent a seat, or in an armchair or seat, such as those located in theaters, arenas, stadiums, outdoor seating areas, etc. Adapter 420 has a larger cylindrical bore 422 and a smaller cylindrical bore 423 that friction-tightly or loosely receives a correspondingly shaped cylindrical lower part 166 of the support 160. The adapter 420 has a tapered, frustoconically-shaped lower part 424 that is friction-tightly received in a cupholder compartment. An annular recess 426 is advantageously provided to provide a snap-type action between the lower part 424 and the cupholder. The lower part 424 is inserted into the cupholder to an extent dependent upon the depth of the compartment, and preferably until the recess 426 is reached.

Similarly, adapter 460 has a larger cylindrical bore 462 and a smaller cylindrical bore 463 that friction-tightly or loosely receives a correspondingly shaped cylindrical lower part 166 of the support 160. The adapter 460 has a tapered, frustoconically-shaped lower part 464 that is friction-tightly received in a cupholder compartment. An annular recess 466 is advantageously provided to provide a snap-type action between the lower part 464 and the cupholder. The lower part 464 is inserted into the cupholder to an extent dependent upon the depth of the compartment, and preferably until the recess 466 is reached. An angled slot 468 is also provided and is sized to receive and hold a cell phone or other electronic device (not illustrated).

Figure 32:
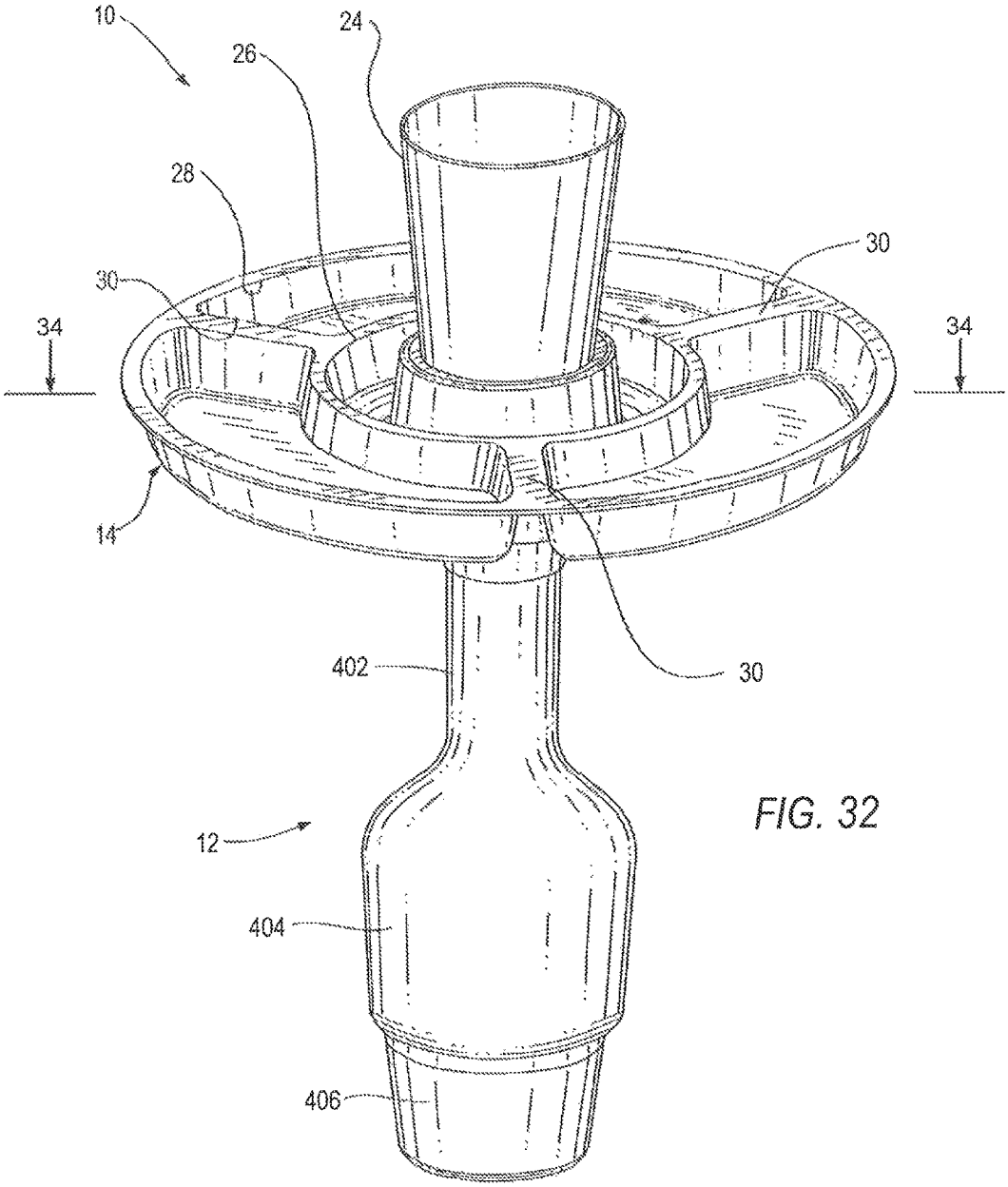
FIG. 32 is a perspective view of a portable food service assembly in accordance with yet another embodiment of this disclosure.

FIG. 32 depicts the plate 14 of the embodiment of FIGS. 1-7, connected, as described above, with a snap-type connection, to a modified bottle-shaped support 12, in which a generally cylindrical handle portion 402 is located above a first enlarged frustoconically-shaped holder portion 404 that, in turn, is located above a second enlarged frustoconically-shaped holder portion 406. The holder portions 404, 406 need not be frustoconically-shaped, and the support can comprise only one of these holder portions, or additional holder portions. Each holder portion 404, 406 is configured to be received in a correspondingly sized compartment in a cupholder that may be provided in a vehicle, such as a car, boat, or plane, typically in a console or dashboard area adjacent a seat, or in an armchair or seat, such as those located in theaters, arenas, stadiums, outdoor seating areas, etc. Thus, the support 12 of FIG. 32 enables the plate 14 and the cup 24 to be conveniently supported and stably held anyplace where a cupholder exists. No additional adapter is required, because at least one of the holder portions 404, 406 will fit into the correspondingly sized compartment of the cupholder. The bottle-shaped support 12 of FIG. 32 is hollow to accommodate any of the aforementioned beverages, including alcohol.

Figure 33:
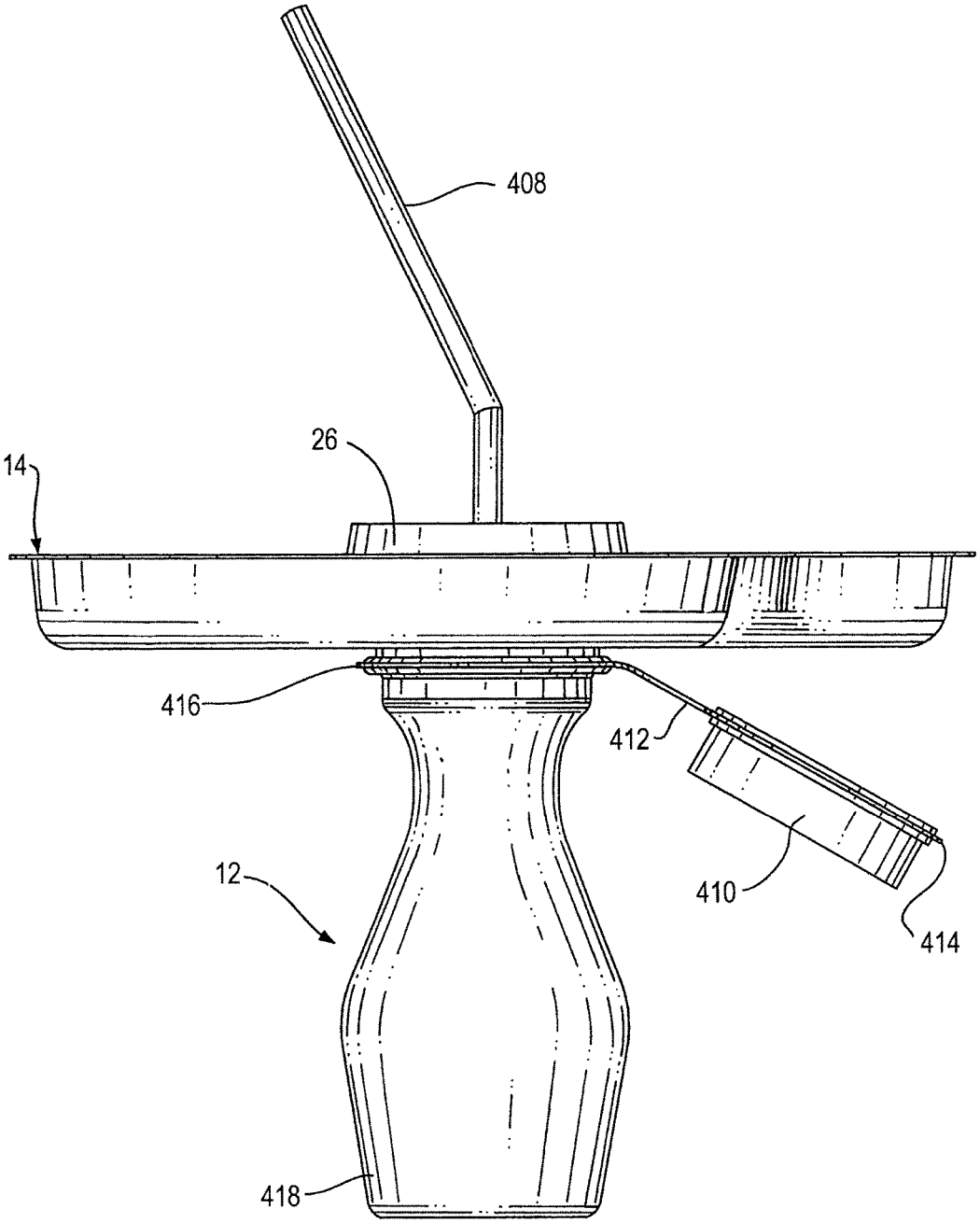
FIG. 33 is a side elevational view of a portable food service assembly in accordance with a further embodiment of this disclosure.

FIG. 33 is analogous to FIG. 32, in that the plate 14 is connected, as described above, with a snap-type, press fit, or loose fit connection, to the support 12, except that the support 12 has a different hourglass-like shape or a bottle shape, and is hollow to contain a beverage, and the cup 24 has been replaced by a straw 408. In addition, a cap 410 is provided for opening and closing the hollow support 12, and a tether 412 is provided for connecting the cap 410 to the hollow support 12. The tether 412 has annular rings 414, 416 that are received in annular grooves formed in the cap and the hollow support. When the support 12 is disconnected from the plate 14, the cap 410 can be mounted on the upper open end of the support 12 to seal the contents therein. The support 12 of FIG. 33 has a tapered holder portion 418 configured to be received in a correspondingly sized compartment in a cupholder that may be provided in a vehicle, or in an armchair or seat, as described above. Thus, the support 12 of FIG. 33 enables the plate 14 to be conveniently supported and stably held anyplace where a cupholder exists. No additional adapter is required. The bottle-shaped support 12 of FIG. 33 is hollow to accommodate any of the aforementioned beverages, including alcohol.

Figure 35:
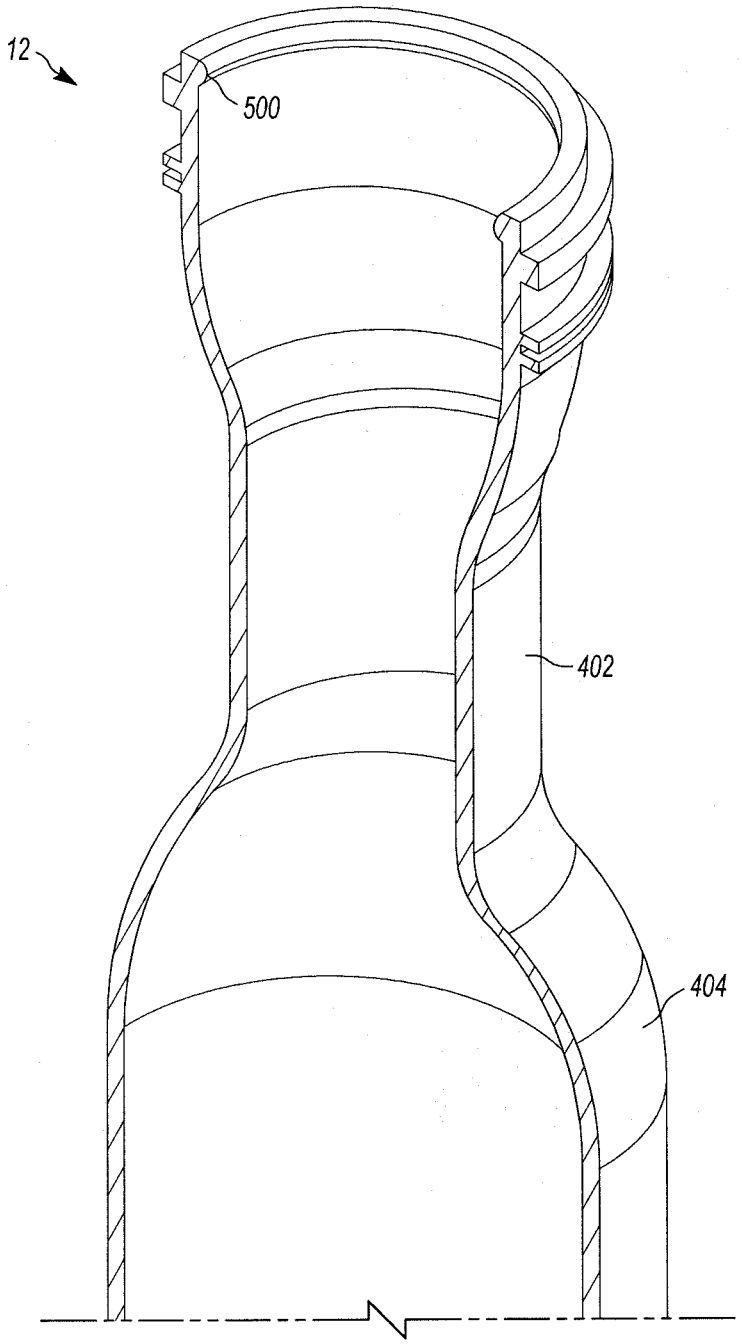
FIG. 35 is a broken-away, enlarged, sectional view of a support for use with the embodiment of FIG. 32.
Figure 36:
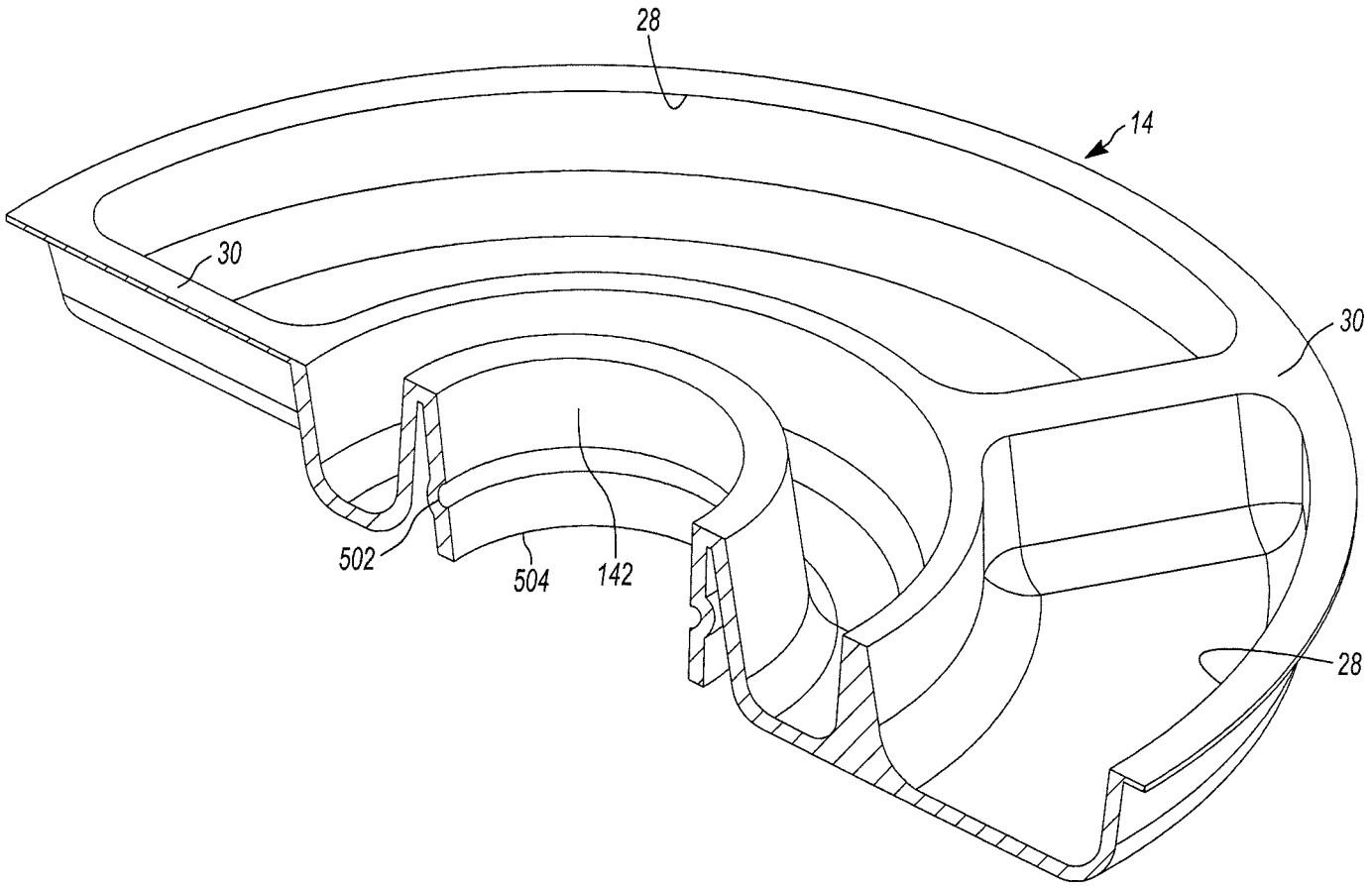
FIG. 36 is a broken-away, enlarged, sectional view of a plate for use with the embodiment of FIG. 32.

FIGS. 34-37 depict the embodiment of FIG. 32 in more detail. The plate 14 is connected, as described below, with a snap-type fit connection, to a support 12. As shown in FIG. 35, the support 12 is hollow and includes the above-described, generally cylindrical handle portion 402 located above the above-described, first enlarged frustoconically-shaped holder portion 404. This invention is not intended to be limited to this particular illustrated configuration for the support 12, because many other configurations may also be used. As shown in FIG. 36, the plate 14 advantageously includes the above-described, food compartments 28 separated by the above-described, radial ribs 30, as well as the above-described, central, hollow, annular extension portion 142 that is integral with the plate 14.

Figure 37:
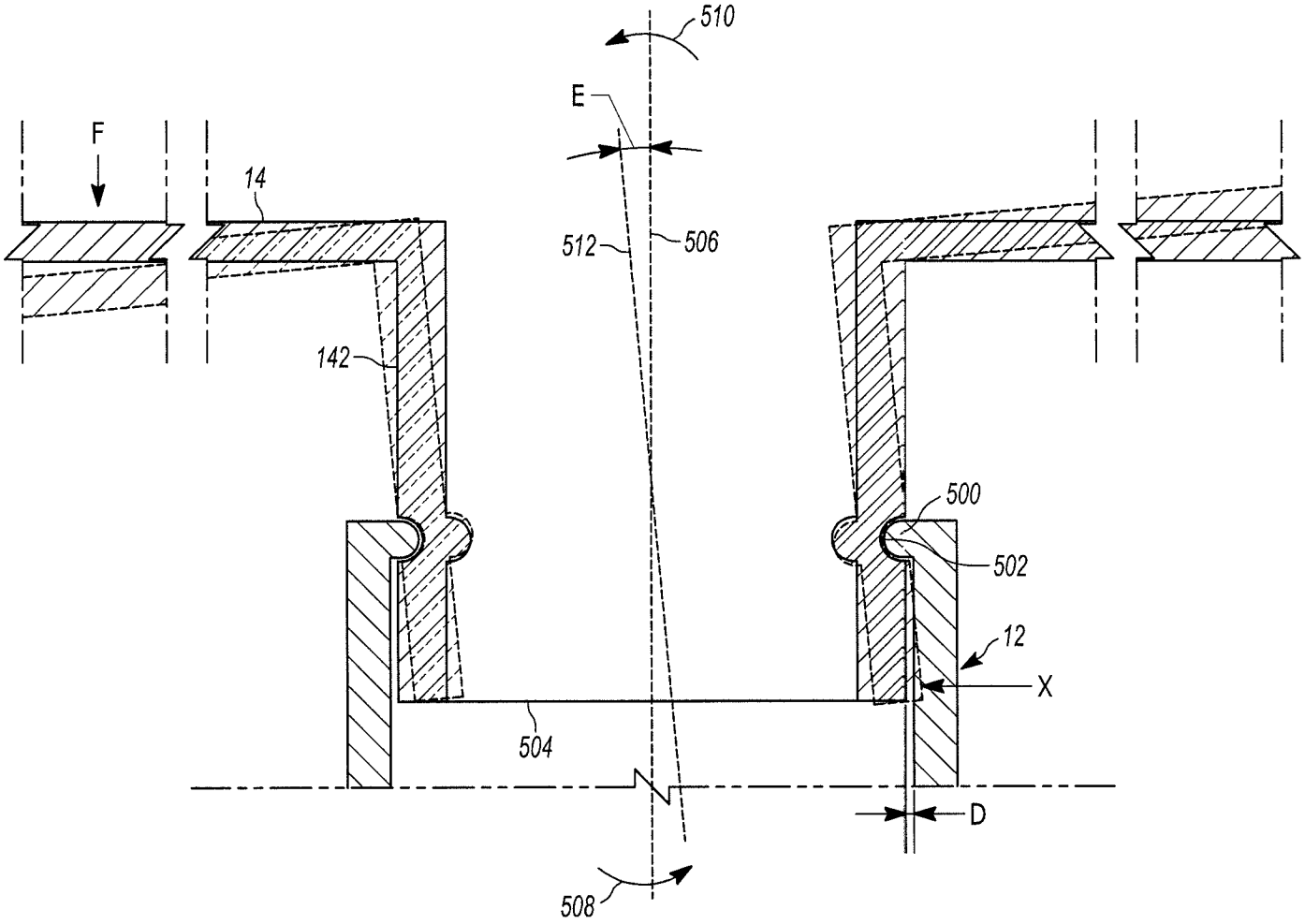
FIG. 37 is a broken-away, enlarged, sectional view of the snap-fit interconnection in the embodiment of FIG. 32 in solid lines, and depicting movement between the plate and the support in phantom lines.

Advantageously, a radially inwardly-extending, annular projection 500 is provided on the support 12, and a corresponding radially inwardly-extending, annular recess 502 is provided on the extension portion 142. Alternatively, the projection 500 and the recess 502 could also extend radially outwardly. The projection 500 and the recess 502 are concentric with a central longitudinal axis 506 (FIG. 37). The projection 500 is preferably formed at the top of the support 12 as illustrated in FIG. 35, but could also be formed axially away from the top of the support 12. The recess 502 is preferably formed axially away from an axial end region or bottom 504 of the extension portion 142 as illustrated in FIGS. 36-37, but could also be formed at the bottom 504. As best seen in FIG. 37, the recess 502 receives the projection 500 with a resilient, snap-type action when the plate 14 is mounted on, and axially lowered and fitted onto, the support 12.

As best seen in FIG. 37, a lower end region of the extension portion 142, i.e., the region between the recess 502 and the bottom 504 of the extension portion 142, enters and remains inside the hollow support 12 during the snap-fit mounting. As described below, this stabilizes the snap-fit connection between the support 12 and its overlying plate 14 to resist their disengagement during use, and to prevent the disengaged plate 14 from excessive tilting relative to the longitudinal axis 506 and falling completely off the support 12. Such tilting can be caused by many factors. As shown in FIG. 37, tilting may be caused by a force F exerted downwardly on the plate 14 at the left side of the central longitudinal axis 506, thereby causing the plate 14 to tilt, as shown in phantom lines, in the direction of the arrow 510 (FIG. 37) by a lever effect. This force F might be exerted by the weight of a food placed in the compartment 28 of the plate 14 at the left side of the central longitudinal axis 506, or might be exerted by a bump that is downwardly applied, typically accidentally, against a periphery of the plate 14 at the left side of the axis 506. During this tilt, the axis 506 is angularly moved and displaced through an angle E to the position shown by tilted axis 512. Even when the magnitude of the force F applied to the periphery of the plate 14 is small, the magnitude is amplified by the radial distance between the force F and the projection 500 due to the lever effect. The larger the plate 14, the larger the radial distance, and the greater the amplification. It will be understood that this invention is not intended to be limited to downwardly applied forces exerted at the left side of the axis 506, but could equally well apply to downwardly applied forces exerted at the right side of the axis 506. In addition, the force F could also be applied upwardly at either side of the axis 506.

The presence of the lower end region of the extension portion 142 inside the hollow support 12 affirmatively prevents the plate 14 from falling off the support 12 onto the floor when the force F is exerted. Thus, the lower end region of the extension portion 142 will move in the direction of the arrow 508 and physically engage the support 12 at the contact zone X (FIG. 37) and affirmatively act to prevent any such fall or disengagement from the support 12. The distance D (FIG. 37) or radial clearance between the outer surface of the lower end region of the extension portion 142 and the inner surface of the upper end of the support 12 represents the maximum travel distance through which the lower end region of the extension portion 142 can travel before engaging and contacting the inner wall surface of the support at the contact zone X. The plate 14 can only be removed from the support 12 by some affirmative, deliberate lifting action, for example, by lifting the plate 14 vertically off the support 12 along the axis 506 with a sufficient lifting force to overcome the snap-fit connection. Analogously, if the plate 14 were tilted in the direction opposite to arrow 510, for example, if the force F were downwardly applied at the right side of the plate 14, then the lower end region of the extension portion 142 will move in the direction opposite to the arrow 508, through the distance D until the outer surface of the lower end region of the extension portion 142 contacted the inner surface of the upper end of the support 12 at the opposite side of the axis 506, again to counteract any disengagement.

As previously mentioned in connection with FIG. 6, the projection 38 may be spaced axially away from the bottom end of the extension portion of the plate 14, and the recess 36 may be spaced axially away from the top end of the support 12. In this case, the support 12 extends into the extension portion of the plate 14, and the mutual engagement between the support and the extension portion, both above and below the snap-fit connection, affirmatively prevents the plate 14 from falling off the support 12 onto the floor.

In accordance with this disclosure, the portable organizer or food service assembly includes a plate and a support. The plate can be readily attached to, and detached from, the support with a non-threaded connection. Advantageously, the non-threaded connection between the plate and the support is a snap-type action, or a friction fit, or an interference fit, or a clearance fit. Preferably, the connection between the plate and the support affirmatively resists excessive tilting of the plate, and prevents the plate from disengaging from the support. Even if the plate 14 becomes disengaged from the support 12, the clearance fit of the lower end region of the extension portion 142 inside the hollow support 12 provides room, as exemplified by the distance D, through which the plate 14 can still wobble or tilt relative to the support 12. The cup can be mounted on the plate or the support. Eating utensils and accessories are advantageously mounted on the support. Cups of different sizes are readily accommodated and preferably held in the center of the portable assembly for better balance. The portable assembly has a center of gravity positioned such that the assembly can readily be carried and supported by an individual from one place to another with one hand, without spillage, and can be readily supported and held on a support surface without tipping. The eating utensils and accessories, as well as the user's hand, are safely held away from the food and drink for hygienic purposes, thereby resisting the spread of disease. Thus, even if a user's hand is contaminated, the contamination will not spread to the food, drink, and eating utensils and accessories. This is of particular importance in the event of an emergency such that the organizer described herein also serves as a survival kit. All the components of the assembly are disposable, biodegradable, and, if desired, reusable. Some of the components, e.g., the support, may even be readily obtainable. Thus, a cardboard tube obtained from a paper roll in one's home, or a packaging tube obtained from a parcel delivery, can be used to support the plate.

In the foregoing specification, specific embodiments have been described. However, one of ordinary skill in the art appreciates that various modifications and changes can be made without departing from the scope of the disclosure. Accordingly, the specification and figures are to be regarded in an illustrative rather than a restrictive sense, and all such modifications are intended to be included within the scope of present teachings. The food and drink organizer described herein can also be used by campers, or military personnel, or participants in any outdoor or indoor activities, such as picnics, block parties, beach activities, hiking, or sports activities, especially those where it is difficult to keep one's hands clean.

The benefits, advantages, solutions to problems, and any element(s) that may cause any benefit, advantage, or solution to occur or become more pronounced are not to be construed as a critical, required, or essential features or elements of the disclosure.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, contains a list of elements does not include only those elements, but may include other elements not expressly listed or inherent to such process, method, article, or apparatus. An element proceeded by "comprises . . . a," "has . . . a," "includes . . . a," or "contains . . . a," does not, without more constraints, preclude the existence of additional identical elements in the process, method, article, or apparatus that comprises, has, includes, or contains the element. The terms "a" and "an" are defined as one or more unless explicitly stated otherwise herein. The terms "substantially," "essentially," "approximately," "about," or any other version thereof, are defined as being close to, as understood by one of ordinary skill in the art. The term "coupled" is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the disclosure. In addition, in the foregoing Detailed Description, it can be seen that various features are grouped together in various embodiments for the purpose of streamlining the disclosure. This method of disclosure is not to be interpreted as reflecting an intention that the disclosed embodiments require more features than are expressly recited. Rather, inventive subject matter resides in less than all features of a single disclosed embodiment.

I claim:

1. A portable food service assembly, comprising:

an upright, hollow support configured to be gripped by a user's hand and extending along a longitudinal axis, the support having an annular projection extending circumferentially around the longitudinal axis; and a plate having a plurality of individual, upwardly open, food compartments for containing and accessing food, the plate having an annular, central portion that is integral with the plate, the food compartments extending from the central portion in radial directions radially of the longitudinal axis to a periphery of the plate, the central portion extending along the longitudinal axis and terminating in a bottom end, the central portion having an annular recess extending circumferentially around the longitudinal axis, the recess being spaced axially away from the bottom end, the recess radially receiving the projection with a non-threaded, snap fit by axial movement of the central portion and the support relative to each other along the longitudinal axis, the central portion engaging the support to prevent accidental disengagement of the snap fit and to prevent tilting of the plate relative to the longitudinal axis.

2. The food service assembly of claim 1, wherein the support terminates in a top end, and wherein the projection is formed at the top end.

3. The food service assembly of claim 1, wherein the support terminates in a top end, and wherein the projection is spaced axially away from the top end.

4. The food service assembly of claim 1, wherein the central portion extends inside the support.

5. The food service assembly of claim 1, wherein the support extends inside the central portion.

6. The food service assembly of claim 1, wherein the projection extends radially inwardly toward the longitudinal axis, and wherein the recess extends radially inwardly toward the longitudinal axis.

7. The food service assembly of claim 1, wherein the support has a top end and an opposite bottom end, and has a frustoconical shape between the top and bottom ends.

8. The food service assembly of claim 1, and a container for containing a liquid, the container being mounted on one of the plate and the support.

9. The food service assembly of claim 8, and a plurality of resiliently yieldable elements arranged in an annulus around the longitudinal axis on the plate for adjustably receiving and holding the container on the plate when the container is inserted between the elements.

10. The food service assembly of claim 1, and an adapter having one part connected to the plate, and another part connected to the support.

11. The food service assembly of claim 10, and serrated edges between at least one of the adapter parts and one of the plate and the support, for interconnecting the adapter between the plate and the support.

12. The food service assembly of claim 1, wherein the support is located below the plate and has slots through which eating utensils are received and supported.

13. The food service assembly of claim 1, wherein the support is extendable and collapsible along the longitudinal axis, and is flexible and tiltable relative to the longitudinal axis.

14. The food service assembly of claim 1, wherein the support is initially flat and is subsequently rolled in an annulus around the longitudinal axis.

15. The food service assembly of claim 6, and a cover fixedly mounted above the plate, and an internal holder for engaging and holding the container in a fixed position on the plate, the cover having a handle by which the assembly can be held and carried from place to place, the handle being centrally located on the cover and on opposite sides of the longitudinal axis.

16. The food service assembly of claim 1, and additional plates mounted on the support, the plates having different outer dimensions and being stacked one above another, each additional plate having a plurality of individual food compartments for containing food.

17. The food service assembly of claim 1, wherein the support has a base that is magnetically attractable to a support surface.

18. The food service assembly of claim 1, and a clamp attached to the support for clamping the assembly on a support surface.

19. The food service assembly of claim 18, and an adapter mounted on the clamp and having an interior, and a resilient cushion mounted in the interior of the adapter, and wherein a part of the support is received in the interior of the adapter in resilient engagement with the cushion to compensate for tilting of the support relative to the longitudinal axis.

20. The food service assembly of claim 1, wherein the support has a holder portion for direct placement in a compartment of a cupholder when not carried by the user's hand, the holder portion having a tapered shape configured to be adjustably received in the compartment.

21. The food service assembly of claim 1, and a tapered adapter for direct and adjustable placement in a compartment of a cupholder when not carried by the user's hand, and wherein the support has a holder portion received in a bore of the adapter.

22. The food service assembly of claim 1, and a cap for opening and closing the hollow support, and a tether for connecting the cap to the hollow support, the tether having annular rings, and the cap and the hollow support having annular grooves for receiving the rings.

23. The food service assembly of claim 1, wherein the support includes a stack of multiple supports vertically stacked one atop another, one of the supports having a side wall formed with a resilient flap that frictionally grips a side wall of another of the supports, thereby holding the stacked supports apart by a predetermined distance.

24. The food service assembly of claim 23, wherein the resilient flap forms an opening in the side wall of the one support, and wherein the opening is used to support an item.

25. The food service assembly of claim 8, wherein the plate has a central opening, and further comprising an annular bowl surrounding the container to collect liquid spillage from the container.

26. The food service assembly of claim 1, wherein the plate has a central opening, and wherein the support has an interior for containing a liquid; and further comprising a plug movable between a closed position in which the plug is mounted in the central opening, and an open position in which the plug is remote from the central opening; and a drinking straw inserted through the central opening into the support in the open position of the plug.

27. A portable food service assembly, comprising:

an upright, hollow support configured to be gripped by a user's hand and extending along a longitudinal axis to terminate in a top end;

a plate having a plurality of individual, upwardly open, food compartments for containing and accessing food, the plate having an annular, central portion that is integral with the plate, the food compartments extending from the central portion in radial directions radially of the longitudinal axis to a periphery of the plate, the central portion extending along the longitudinal axis and terminating in a bottom end;

an annular projection provided on one of the central portion and the support, and extending circumferentially around the longitudinal axis, the projection being spaced axially away from one of the ends; and an annular recess provided on the other of the central portion and the support, the recess extending circumferentially around the longitudinal axis and being spaced axially away from the other of the ends, the recess radially receiving the projection with a non-threaded, snap fit by axial movement of the central portion and the support relative to each other along the longitudinal axis, the central portion engaging the support to prevent accidental disengagement of the snap fit and to prevent tilting of the plate relative to the longitudinal axis.

28. A portable food service assembly, comprising:

an upright, hollow support configured to be gripped by a user's hand and extending along a longitudinal axis to terminate in an annular top end; and a plate having a plurality of individual, upwardly open, food compartments for containing and accessing food, the plate having an annular, central portion that is integral with the plate, the food compartments extending from the central portion in radial directions radially of the longitudinal axis to a periphery of the plate, the central portion extending along the longitudinal axis and terminating in a bottom end, the central portion having an annular recess extending circumferentially around the longitudinal axis at the bottom end, the recess axially receiving the top end with a non-threaded fit by axial movement of the central portion and the support relative to each other along the longitudinal axis, the plate being turnable on the top end about the longitudinal axis, the central portion engaging the support to prevent accidental disengagement of the non-threaded fit and to prevent tilting of the plate relative to the longitudinal axis.

29. A portable service assembly, comprising:

a carrier for carrying at least one container for containing a liquid and a plate for containing a foodstuff;

a cover securely mounted to the carrier, the cover having outer and inner surfaces;

an internal holder centrally located on the inner surface of the cover for engaging and securing the at least one container on the carrier;

a handle for holding and carrying the carrier with the at least one container from place to place in a balanced condition, the handle being centrally located on the outer surface of the cover; and a support connected to the carrier for direct placement in a compartment of a cupholder.

30. The portable service assembly of claim 29, wherein the holder is configured to engage containers of different sizes and shapes.

31. The portable service assembly of claim 1, wherein the plate and the support are each made of a disposable, biodegradable material.

32. The portable service assembly of claim 16, wherein the plates are circular, and wherein the different outer dimensions of the plates are different diameters.

* * * * *